US010957274B1

(12) United States Patent
Iwasa

(10) Patent No.: US 10,957,274 B1
(45) Date of Patent: Mar. 23, 2021

(54) LIQUID CRYSTAL DEVICE, WAVELENGTH SELECTION OPTICAL SWITCH APPARATUS, AND PIXEL INSPECTION METHOD OF LIQUID CRYSTAL DEVICE

(71) Applicant: JVCKENWOOD CORPORATION, Yokohama (JP)

(72) Inventor: Takayuki Iwasa, Yokohama (JP)

(73) Assignee: JVCKENWOOD CORPORATION, Kanagawa (JP)

( * ) Notice: Subject to any disclaimer, the term of this patent is extended or adjusted under 35 U.S.C. 154(b) by 0 days.

(21) Appl. No.: 16/991,724

(22) Filed: Aug. 12, 2020

(30) Foreign Application Priority Data

Sep. 5, 2019 (JP) ..... JP2019-161774

(51) Int. Cl.
*G09G 3/36* (2006.01)

(52) U.S. Cl.
CPC ..... *G09G 3/3688* (2013.01); *G09G 3/3614* (2013.01); *G09G 3/3677* (2013.01); *G09G 3/3696* (2013.01); *G09G 2310/0294* (2013.01); *G09G 2330/12* (2013.01)

(58) Field of Classification Search
CPC .. G09G 3/3688; G09G 3/3614; G09G 3/3677; G09G 3/3696; G09G 2310/0294; G09G 2330/12
See application file for complete search history.

(56) References Cited

U.S. PATENT DOCUMENTS

2009/0219238 A1* 9/2009 Furuya ..... G09G 3/3655 345/87

FOREIGN PATENT DOCUMENTS

JP 2009223289 A 10/2009

* cited by examiner

*Primary Examiner* — Kenneth B Lee, Jr.
(74) *Attorney, Agent, or Firm* — Procopio, Cory, Hargreaves & Savitch LLP

(57) ABSTRACT

A liquid crystal display apparatus includes a plurality of pixels that form a plurality of pixel pairs, each of the pixel pairs being adjacent two pixels in one column, in which, in each of the pixel pairs, a first switch transistor that switches whether or not to output a voltage of a video signal written into one of the pixels to a corresponding data line and a second switch transistor that switches whether or not to output a voltage of a video signal written into the other one of the pixels to a corresponding data line are composed in such a way that they are controlled to be turned on or off by a common switch selection signal for reading.

11 Claims, 17 Drawing Sheets

LIQUID CRYSTAL DEVICE, WAVELENGTH SELECTION OPTICAL SWITCH APPARATUS, AND PIXEL INSPECTION METHOD OF LIQUID CRYSTAL DEVICE

CROSS REFERENCE TO RELATED APPLICATION

This application is based upon and claims the benefit of priority from Japanese patent application No. 2019-161774, filed on Sep. 5, 2019, the disclosure of which is incorporated herein in its entirety by reference.

BACKGROUND

The present disclosure relates to a liquid crystal device, a wavelength selection optical switch apparatus, and a pixel inspection method of the liquid crystal device, and relates to a liquid crystal device, a wavelength selection optical switch apparatus, and a pixel inspection method of the liquid crystal device suitable for executing inspection of pixels while preventing the size of the circuit from increasing.

A liquid crystal display apparatus disclosed in Japanese Unexamined Patent Application Publication No. 2009-223289 includes a plurality of pixels arranged in a matrix, a plurality of sets of data lines provided so as to correspond to respective columns of the plurality of pixels, a plurality of gate lines provided so as to correspond to respective rows of the plurality of pixels, a plurality of switches for supplying positive-polarity and negative-polarity video signals to a plurality of sets of data lines in order in a set unit, and driving means for driving the plurality of switches and the plurality of gate lines.

SUMMARY

Incidentally, it is required for the liquid crystal display apparatus to inspect pixels to determine, for example, whether or not there are defects or deterioration in characteristics before shipping of products in order to improve reliability.

Japanese Unexamined Patent Application Publication No. 2009-223289 does not disclose, however, a specific method of inspecting pixels. Therefore, if an inspection circuit for inspecting pixels is incorporated into the liquid crystal display apparatus disclosed in Japanese Unexamined Patent Application Publication No. 2009-223289, the number of control signal lines used for inspection of pixels increases, which causes wiring congestion. If the wiring gap is made sufficiently large in order to avoid this wiring congestion, it causes a problem that the pixel pitches increase and the size of the circuit ends up being increased.

A liquid crystal device according to one aspect of an embodiment includes: a plurality of pixels arranged in a matrix; a plurality of first data lines provided so as to correspond to respective columns of the plurality of pixels; a plurality of second data lines provided so as to correspond to respective columns of the plurality of pixels; and a switch circuit configured to switch ON and OFF between each of the plurality of first data lines and a first external terminal and switch ON and OFF between each of the plurality of second data lines and a second external terminal, in which the plurality of pixels form a plurality of pixel pairs, each of the pixel pairs being a first pixel and a second pixel that are two pixels adjacent to each other in one column, in each of the pixel pairs, the first pixel includes: a first sample and hold circuit configured to sample and hold a positive-polarity video signal supplied from the first external terminal to the corresponding first data line via the switch circuit; a second sample and hold circuit configured to sample and hold a negative-polarity video signal supplied from the second external terminal to the corresponding second data line via the switch circuit; a first liquid crystal display element composed of a first pixel drive electrode, a common electrode, and liquid crystal sealed therebetween; a first polarity changeover switch configured to select one of a voltage of the positive-polarity video signal held by the first sample and hold circuit and a voltage of the negative-polarity video signal held by the second sample and hold circuit and control whether or not to apply the selected voltage to the first pixel drive electrode; and a first switch transistor configured to switch whether or not to output the voltage applied to the first pixel drive electrode via the first polarity changeover switch to the corresponding first data line or the corresponding second data line as a pixel drive voltage, the second pixel includes: a third sample and hold circuit configured to sample and hold a positive-polarity video signal supplied from the first external terminal to the corresponding first data line via the switch circuit; a fourth sample and hold circuit configured to sample and hold a negative-polarity video signal supplied from the second external terminal to the corresponding second data line via the switch circuit; a second liquid crystal display element composed of a second pixel drive electrode, a common electrode, and liquid crystal sealed therebetween; a second polarity changeover switch configured to select one of a voltage of the positive-polarity video signal held by the third sample and hold circuit and a voltage of the negative-polarity video signal held by the fourth sample and hold circuit and control whether or not to apply the selected voltage to the second pixel drive electrode; and a second switch transistor configured to switch whether or not to output the voltage applied to the second pixel drive electrode via the second polarity changeover switch to the corresponding first data line or the corresponding second data line as a pixel drive voltage, and in each of the pixel pairs, the first switch transistor of the first pixel and the second switch transistor of the second pixel are configured so that they are controlled to be turned on or off by a common control signal.

A pixel inspection method of a liquid crystal device according to one aspect of an embodiment includes: a plurality of pixels arranged in a matrix; a plurality of first data lines provided so as to correspond to respective columns of the plurality of pixels; a plurality of second data lines provided so as to correspond to respective columns of the plurality of pixels; and a switch circuit configured to switch ON and OFF between each of the plurality of first data lines and a first external terminal and switch ON and OFF between each of the plurality of second data lines and a second external terminal, in which the plurality of pixels form a plurality of pixel pairs, each of the pixel pairs being a first pixel and a second pixel that are two pixels adjacent to each other in one column, in each of the pixel pairs, the first pixel includes: a first sample and hold circuit configured to sample and hold a positive-polarity video signal supplied from the first external terminal to the corresponding first data line via the switch circuit; a second sample and hold circuit configured to sample and hold a negative-polarity video signal supplied from the second external terminal to the corresponding second data line via the switch circuit; a first liquid crystal display element composed of a first pixel drive electrode, a common electrode, and liquid crystal sealed therebetween; a first polarity changeover switch configured to select one of a voltage of the positive-polarity video signal held by the first sample and hold circuit and a voltage of the negative-polarity video signal held by the second sample and hold circuit and control whether or not to apply the selected voltage to the first pixel drive electrode; and a first switch transistor configured to switch whether or not to output the voltage applied to the first pixel drive electrode via the first polarity changeover switch to the corresponding first data line or the corresponding second data line as a pixel drive voltage, the second pixel includes: a third sample and hold circuit configured to sample and hold a positive-polarity video signal supplied from the first external terminal to the corresponding first data line via the switch circuit; a fourth sample and hold circuit configured to sample and hold a negative-polarity video signal supplied from the second external terminal to the corresponding second data line via the switch circuit; a second liquid crystal display element composed of a second pixel drive electrode, a common electrode, and liquid crystal sealed therebetween; a second polarity changeover switch configured to select one of a voltage of the positive-polarity video signal held by the third sample and hold circuit and a voltage of the negative-polarity video signal held by the fourth sample and hold circuit and control whether or not to apply the selected voltage to the second pixel drive electrode; and a second switch transistor configured to switch whether or not to output the voltage applied to the second pixel drive electrode via the second polarity changeover switch to the corresponding first data line or the corresponding second data line as a pixel drive voltage, in each of the pixel pairs, the first switch transistor of the first pixel and the second switch transistor of the second pixel are configured so that they are controlled to be turned on or off by a common control signal, in the pixel pair to be inspected, both the first switch transistor of the first pixel and the second switch transistor of the second pixel are turned on, the voltage applied to the first pixel drive electrode from the first sample and hold circuit via the first polarity changeover switch is read out to the corresponding first data line or the corresponding second data line, the voltage applied to the first pixel drive electrode from the second sample and hold circuit via the first polarity changeover switch is read out to the corresponding first data line or the corresponding second data line, the voltage applied to the second pixel drive electrode from the third sample and hold circuit via the second polarity changeover switch is read out to the corresponding first data line or the corresponding second data line, and the voltage applied to the second pixel drive electrode from the fourth sample and hold circuit via the second polarity changeover switch is read out to the corresponding first data line or the corresponding second data line and it is detected, based on the voltages that are read out from each of the first pixel and the second pixel to the corresponding first data line or the corresponding second data line, whether there is a failure in the pixel pair to be inspected.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

<Study in Advance by Inventors>

Prior to giving a description of a liquid crystal display apparatus according to a first embodiment, contents studied in advance by the inventors will be described.

(Configuration of Liquid Crystal Display Apparatus 50 in Conceptual Stage)

Figure 1:
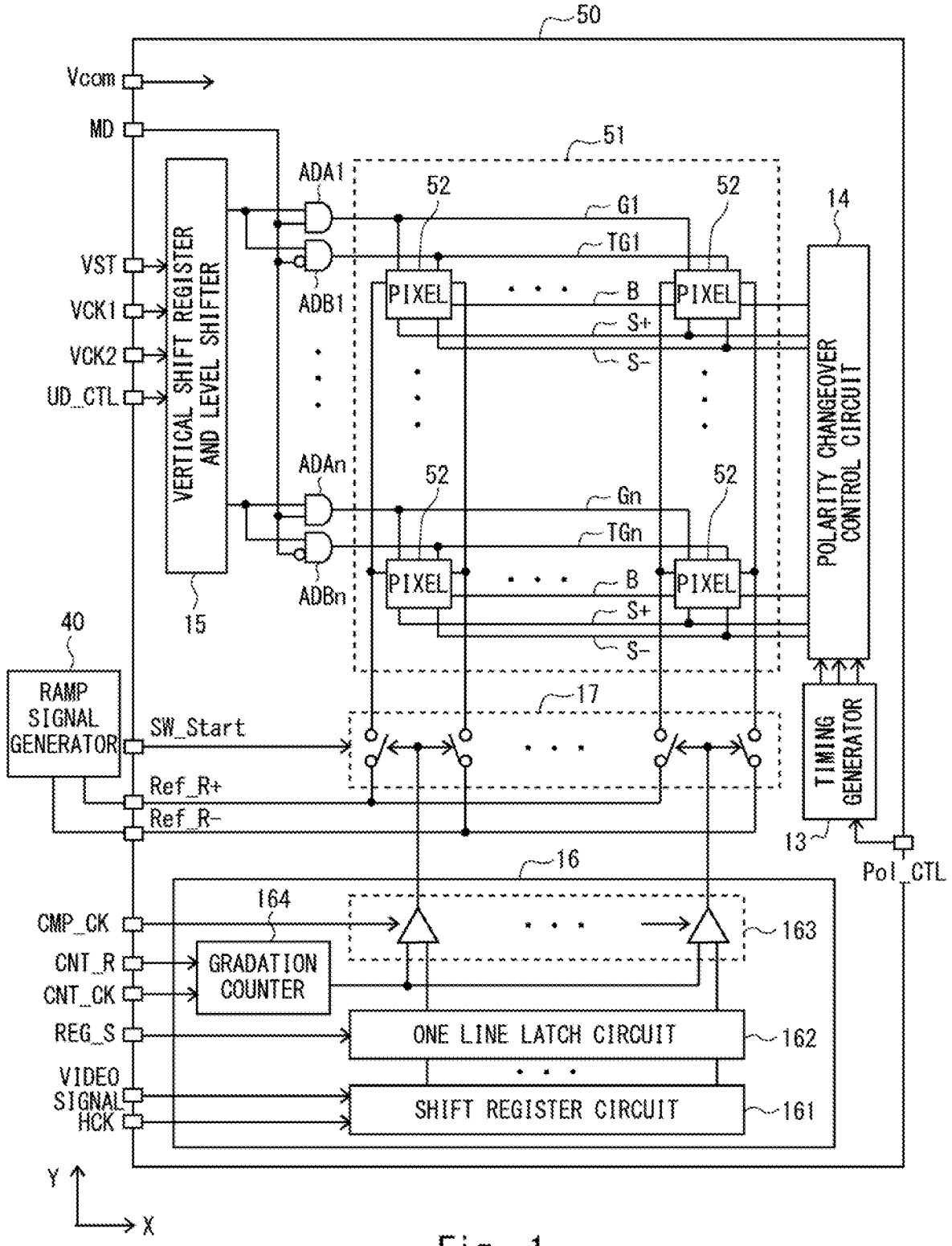
FIG. 1 is a diagram showing a configuration example of a liquid crystal display apparatus in a conceptual stage.

FIG. 1 is a diagram showing a configuration example of an active matrix type liquid crystal display apparatus (liquid crystal device) 50 in a conceptual stage. As shown in FIG. 1, the liquid crystal display apparatus 50 includes an image display unit 51, a timing generator 13, a polarity changeover control circuit 14, a vertical shift register and level shifter 15, a horizontal driver 16, an analog switch unit (switch circuit) 17, and AND circuits ADA1 to ADAn and ADB1 to ADBn.

The horizontal driver 16, which composes a data line drive circuit together with the analog switch unit 17, includes a shift register circuit 161, one line latch circuit 162, a comparator unit 163, and a gradation counter 164. FIG. 1 also shows a ramp signal generator 40 connected to the liquid crystal display apparatus 50 in a normal operation.

Figure 2:
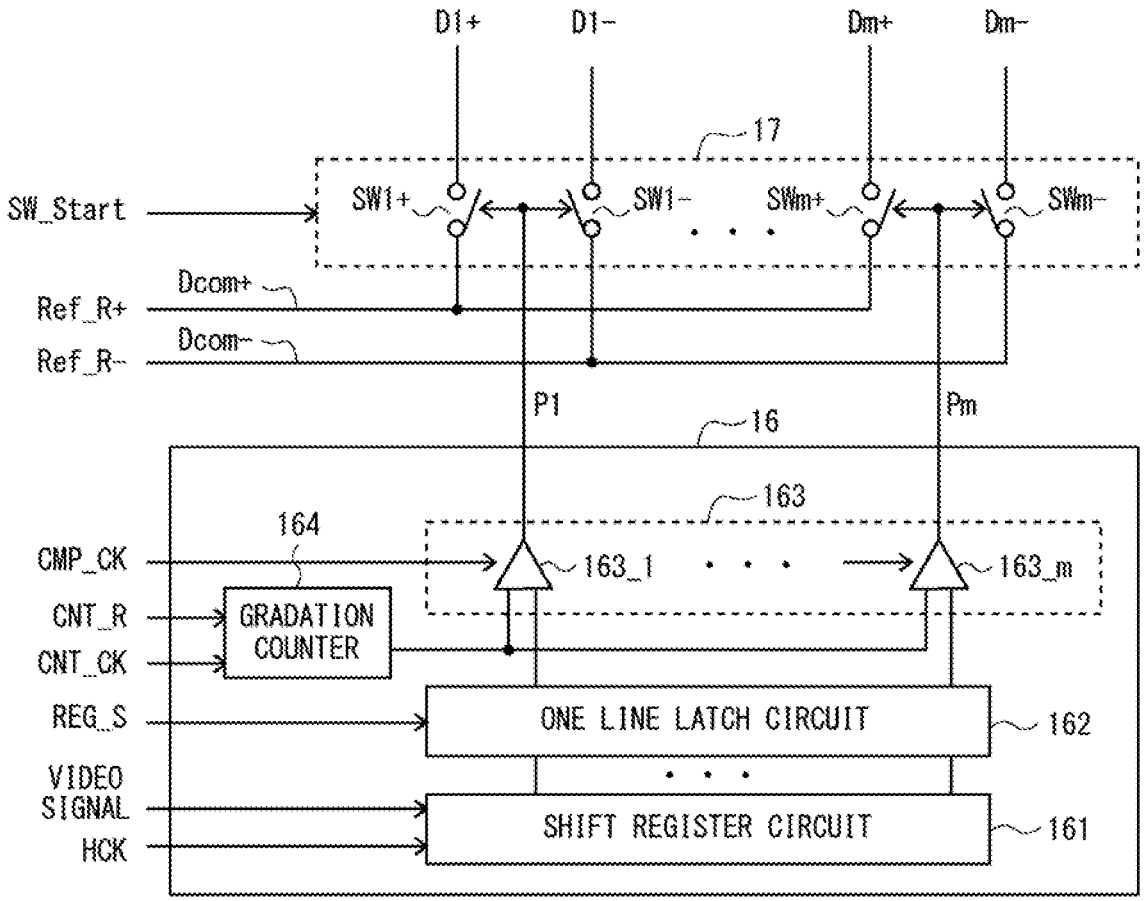
FIG. 2 is a diagram showing a horizontal driver and an analog switch unit provided in the liquid crystal display apparatus shown in FIG. 1 in more detail.

FIG. 2 is a diagram showing the horizontal driver 16 and the analog switch unit 17 provided in the liquid crystal display apparatus 50 in more detail. The comparator unit 163 includes m (m is an integer equal to or larger than two) comparators 163_1 to **163_*m* that correspond to pixels 52 of m columns. The analog switch unit 17 includes m sets of switch elements SW1+, SW1− to SWm+, and SWm− that correspond to pixels 52** of m columns.

In the pixel region of the image display unit 51, row scan lines G1 to Gn of n (n is an integer equal to or larger than two) rows and switch selection lines for reading TG1 to TGn of n rows extending in a horizontal direction (an X-axis direction), and a set of data lines D1+, D1− to Dm+, and Dm− of m columns extending in a vertical direction (a Y-axis direction) are aligned. Further, in the pixel region of the image display unit 51, gate control signal lines S+ and S−, and a gate control signal line B are aligned.

The image display unit 51 includes a plurality of pixels 52 that are regularly arranged. The plurality of pixels 52 are arranged in a two-dimensional matrix form at a total of n×m intersection parts in which the row scan lines G1 to Gn of n rows extending in the horizontal direction (the X-axis direction) intersect with the m sets of data lines D1+, D1− to Dm+, and Dm− extending in the vertical direction (the Y-axis direction).

A row scan line Gj (j is any integer from 1 to n) and a switch selection line for reading TGj are connected in common to each of m pixels 52 arranged in the j-th row. Further, the data lines Di+ and Di−(i is any integer from 1 to m) are connected in common to each of n pixels 52 arranged in the i-th column. Further, each of the gate control signal lines S+ and S− and the gate control signal line B is connected in common to all the pixels 52. Alternatively, each of the gate control signal lines S+ and S− and the gate control signal line B may be provided separately for each row.

The polarity changeover control circuit 14 outputs, based on a timing signal generated by the timing generator 13, a gate control signal for the positive polarity (hereinafter this signal is referred to as a gate control signal S+) to the gate control signal line S+, outputs a gate control signal for the negative polarity (hereinafter this signal is referred to as a gate control signal S−) to the gate control signal line S−, and further outputs a gate control signal (hereinafter this signal is referred to as a gate control signal B) to the gate control signal line B.

The vertical shift register and level shifter 15 outputs scan pulses of n rows from the first row to the n-th row one row at a time in series in a cycle of one horizontal scan period HST. The AND circuits ADA1 to ADAn respectively control, based on a mode switch signal MD externally supplied, whether or not to output the scan pulses of n rows sequentially output from the vertical shift register and level shifter 15 one row at a time to the row scan lines G1 to Gn. The AND circuits ADB1 to ADBn respectively control, based on the mode switch signal MD externally supplied, whether or not to output the scan pulses of n rows sequentially output from the vertical shift register and level shifter 15 one row at a time to the switch selection lines for reading TG1 to TGn.

For example, in a case of an operation in which a video signal is written into the pixel 52 (image writing operation), an H level mode switch signal MD is externally supplied. In this case, the AND circuits ADA1 to ADAn respectively output the scan pulses of n rows sequentially output from the vertical shift register and level shifter 15 one row at a time to the row scan lines G1 to Gn. On the other hand, the AND circuits ADB1 to ADBn do not respectively output the scan pulses of n rows sequentially output from the vertical shift register and level shifter 15 one row at a time to the switch selection lines for reading TG1 to TGn. Therefore, each of the switch selection lines for reading TG1 to TGn is fixed to the L level.

On the other hand, when the video signal written into the pixel 52 is read out (image reading operation), an L level mode switch signal MD is externally supplied. In this case, the AND circuits ADB1 to ADBn respectively output the scan pulses of n rows sequentially output from the vertical shift register and level shifter 15 one row at a time to the switch selection lines for reading TG1 to TGn. On the other hand, the AND circuits ADA1 to ADAn do not respectively output the scan pulses of n rows sequentially output from the vertical shift register and level shifter 15 one row at a time to the row scan lines G1 to Gn. Therefore, each of the row scan lines G1 to Gn is fixed to the L level.

(Specific Configuration Example of Pixel 52)

Figure 3:
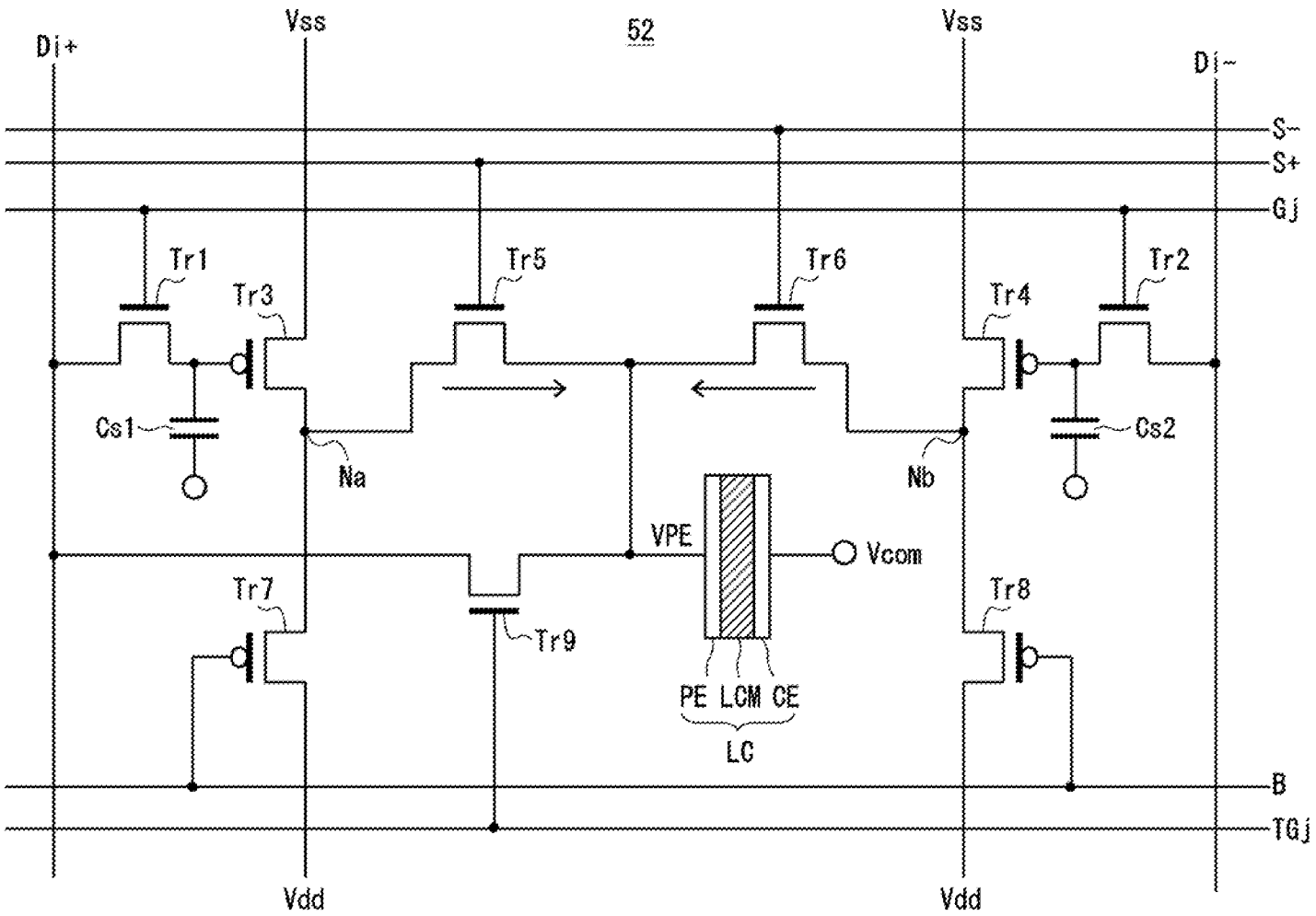
FIG. 3 is a diagram showing a specific configuration example of a pixel provided in the liquid crystal display apparatus shown in FIG. 1.

FIG. 3 is a diagram showing a specific configuration example of the pixel 52. In this example, of pixels 52 of n rows×m columns, the pixel 52 provided in the j-th row and the i-th column will be described.

As shown in FIG. 3, the pixel 52 includes N channel MOS transistors (hereinafter they are simply referred to as transistors) Tr1, Tr2, Tr5, Tr6, and Tr9 and P channel MOS transistors (hereinafter they are simply referred to as transistors) Tr3, Tr4, Tr7, and Tr8.

The transistor Tr1 and a holding capacitor Cs1 compose a sample and hold circuit configured to sample and hold the positive-polarity video signal supplied via the data line Di+. Specifically, in the transistor Tr1, the source is connected to one data line Di+ of the data line pair, the drain is connected to the gate of the transistor Tr3, and the gate is connected to the row scan line Gj. The holding capacitor Cs1 is provided between the gate of the transistor Tr3 and a ground voltage terminal Vss.

The transistor Tr2 and a holding capacitor Cs2 compose a sample and hold circuit configured to sample and hold the negative-polarity video signal supplied via the data line Di−. Specifically, in the transistor Tr2, the source is connected to the other data line Di− of the data line pair, the drain is connected to the gate of the transistor Tr4, and the gate is connected to the row scan line Gj. The holding capacitor Cs2 is provided between the gate of the transistor Tr3 and the ground voltage terminal Vss. Note that the holding capacitors Cs1 and Cs2 are provided independently from each other and respectively hold the positive-polarity and negative-polarity video signals in parallel.

The transistors Tr3 and Tr7 compose a source follower buffer (buffer for impedance conversion) that outputs a voltage held in the holding capacitor Cs1. Specifically, in the transistor Tr3 of the source follower, the drain is connected to the ground voltage line Vss and the source is connected to a node Na. In the transistor Tr7 used as a constant current load in which bias control is possible, the source is connected to a power supply voltage line Vdd, the drain is connected to the node Na, and the gate is connected to the gate control signal line B.

The transistors Tr4 and Tr8 compose a source follower buffer that outputs the voltage held in the holding capacitor Cs2. Specifically, in the transistor Tr4 of the source follower, the drain is connected to the ground voltage line Vss and the source is connected to a node Nb. In the transistor Tr8 used as a constant current load in which bias control is possible, the source is connected to the power supply voltage line Vdd, the drain is connected to the node Nb, and the gate is connected to the gate control signal line B.

The transistors Tr5 and Tr6 compose a polarity changeover switch. Specifically, in the transistor Tr5, the source is connected to the node Na, the drain is connected to a pixel drive electrode PE, and the gate is connected to one gate control signal line S+ of a pair of gate control signal lines. In the transistor Tr6, the source is connected to the node Nb, the drain is connected to the pixel drive electrode PE, and the gate is connected to the other gate control signal line S− of the pair of gate control signal lines.

A liquid crystal display element LC is composed of a pixel drive electrode (reflecting electrode) PE having light reflectivity, a common electrode CE having light transmissivity, the common electrode CE being disposed facing apart from the pixel drive electrode, and liquid crystal LCM filled and sealed in a spatial area between them. A common voltage Vcom is applied to the common electrode CE. The transistor (switch transistor) Tr9 is provided between the pixel drive electrode PE and the data line Di+ and is switched to be on or off by the switch selection line for reading TGj.

Video signals which are sampled by the analog switch unit 17 and have polarities different from each other are supplied to the data line pair Di+ and Di−. When the scan pulse output from the vertical shift register and level shifter 15 is supplied to the row scan line Gj, the transistors Tr1 and Tr2 are concurrently turned on. Accordingly, the voltages of the positive-polarity and negative-polarity video signals are respectively accumulated and held in the holding capacitors Cs1 and Cs2.

Note that the input resistance of the positive-side source follower buffer and that of the negative-side source follower buffer are almost infinite. Therefore, the charge accumulated in the holding capacitor Cs1 and that accumulated in the holding capacitor Cs2 are not leaked and held until a new video signal is written after one vertical scan period is passed.

The transistors Tr5 and Tr6 that compose a polarity changeover switch switch ON/OFF in accordance with the gate control signals S+ and S−, thereby alternately selecting the output voltage of the positive-side source follower buffer (the voltage of the positive-polarity video signal) and the output voltage of the negative-side source follower buffer (the voltage of the negative-polarity video signal) to output the selected voltage to the pixel drive electrode PE. Accordingly, the voltage of the video signal whose polarity is periodically inverted is applied to the pixel drive electrode PE. In this way, in this liquid crystal display apparatus, the pixels themselves have a polarity inversion function. Therefore, by switching the polarity of the voltage of the video signal supplied to the pixel drive electrode PE at a high speed in each pixel, it is possible to perform AC drive at a high frequency regardless of the vertical scan frequency.

(Description of AC Drive Method of Pixel 52)

Figure 4:
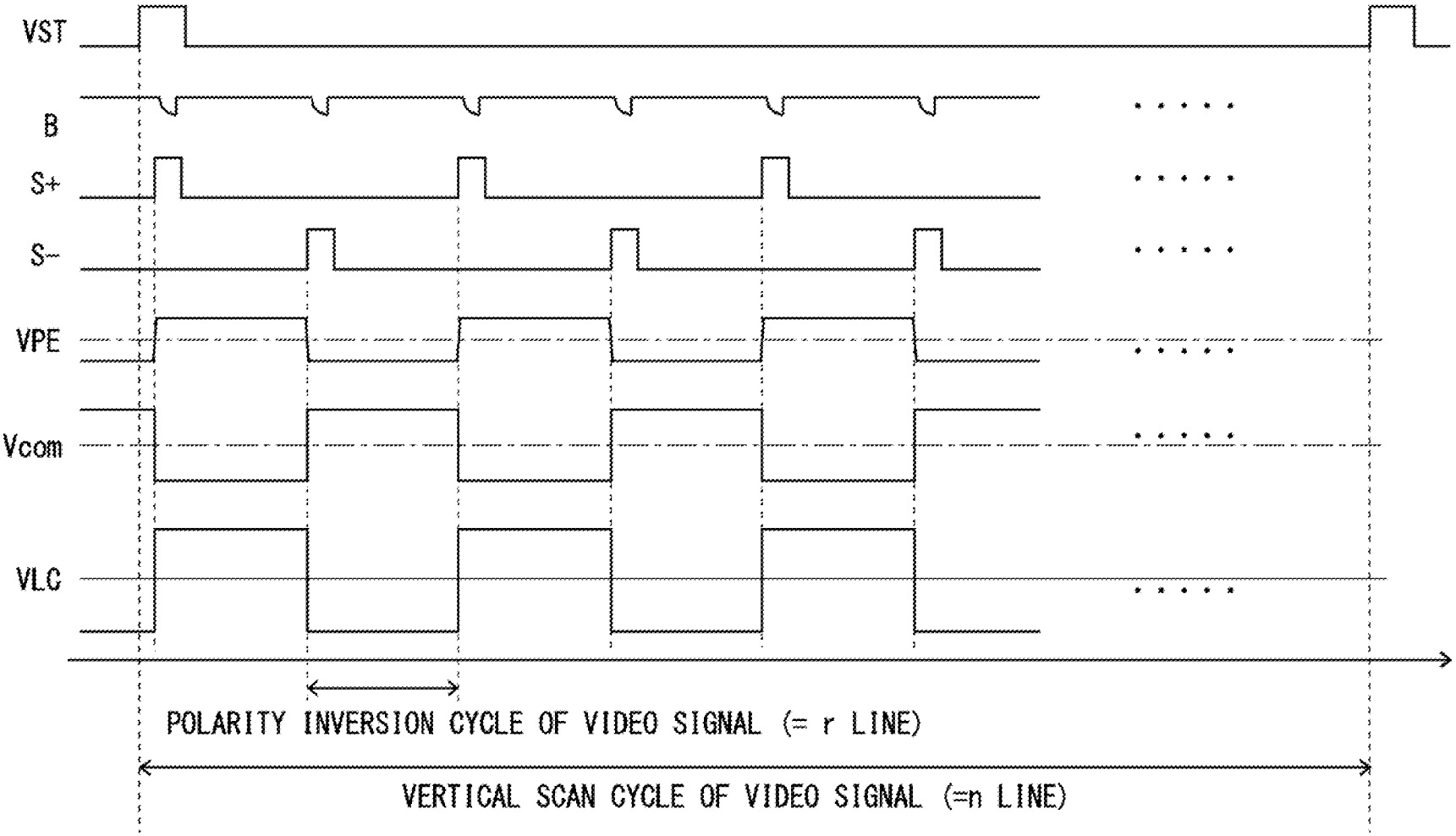
FIG. 4 is a timing chart for explaining a method of driving pixels by the liquid crystal display apparatus shown in FIG. 1.

FIG. 4 is a timing chart for describing an AC drive method of the pixel 52 by the liquid crystal display apparatus 50. In this example, the AC drive method of the pixel 52 provided in the j-th row and the i-th column of the pixels 52 of n rows×m columns will be described.

In FIG. 4, VST indicates a vertical synchronization signal, which is a reference for vertical scan of a video signal. The symbol B indicates a gate control signal to be supplied to each of the gates of the transistors Tr7 and Tr8 used as a constant current load of the source follower buffers of two types. The symbol S+ indicates a gate control signal to be supplied to the gate of the positive-side transistor Tr5 provided in the polarity changeover switch. The symbol S− indicates a gate control signal to be supplied to the gate of the negative-side transistor Tr6 provided in the polarity changeover switch. The symbol VPE indicates a voltage to be applied to the pixel drive electrode PE. The symbol Vcom indicates a voltage to be applied to the common electrode CE. The symbol VLC indicates an AC voltage to be applied to the liquid crystal LCM.

Figure 5:
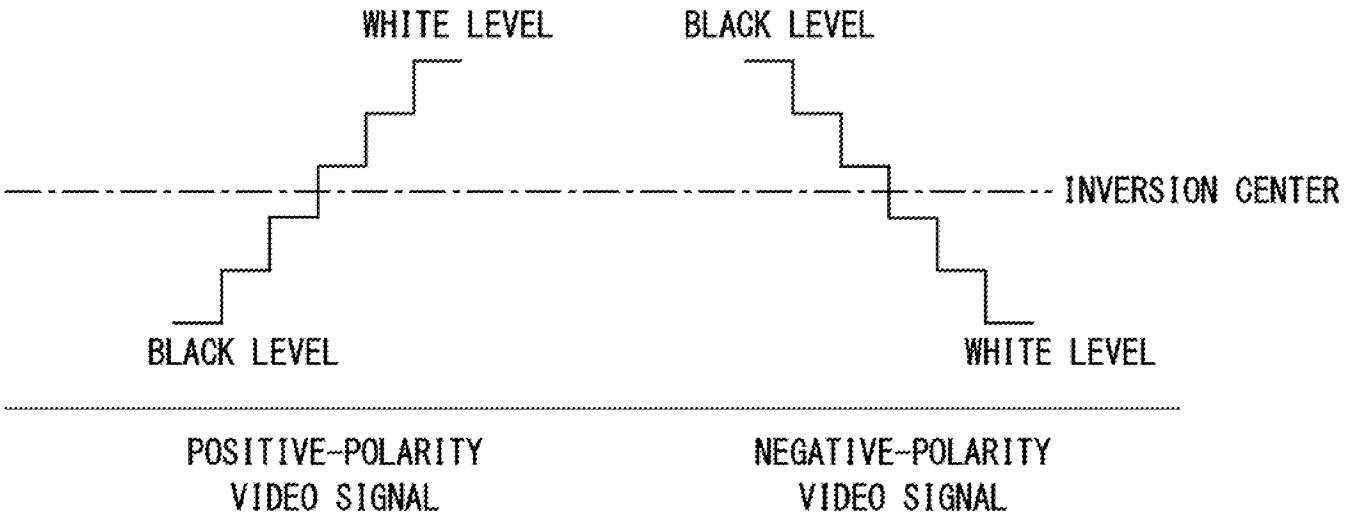
FIG. 5 is a diagram for illustrating a voltage level from black to white of each of a positive-polarity video signal and a negative-polarity video signal written into a pixel.

Further, FIG. 5 is a diagram for illustrating the voltage level from black to white of each of the positive-polarity video signal and the negative-polarity video signal written into the pixel 52. In the example of FIG. 5, the positive-polarity video signal indicates the black level when the voltage level is a minimum and indicates the white level when the voltage level is a maximum. On the other hand, the negative-polarity video signal indicates the white level when the voltage level is a minimum and indicates the black level when the voltage level is a maximum. Alternatively, the positive-polarity video signal may indicate the white level when the voltage level is a minimum and indicate the black level when the voltage level is a maximum. Further, the negative-polarity video signal may indicate the black level when the voltage level is a minimum and indicate the white level when the voltage level is a maximum. The alternate long and short dash line shown in FIG. 5 indicates the inversion center of the positive-polarity video signal and the negative-polarity video signal.

In the pixel 52, the transistor Tr9 maintains the off state when the switch selection line for reading TGj is fixed to the L level. On the other hand, the transistors Tr1 and Tr2 are temporarily turned on when the scan pulse is supplied to the row scan line Gj. When the transistors Tr1 and Tr2 are turned on, the voltages of the positive-polarity and negative-polarity video signals are accumulated and held in the holding capacitors Cs1 and Cs2, respectively.

As shown in FIG. 4, the positive-side transistor Tr5 is turned on in a period in which the gate control signal S+ indicates the H level. At this time, the gate control signal B is set to the L level, which causes the transistor Tr7 to be turned on, whereby the positive-side source follower buffer becomes active. Accordingly, the pixel drive electrode PE is charged to the voltage level of the positive-polarity video signal. Since the gate control signal B is set to the L level, the transistor Tr8 is turned on, whereby the negative-side source follower buffer becomes active. However, since the negative-side transistor Tr6 has been turned off, the pixel drive electrode PE is not charged to the voltage level of the negative-polarity video signal. At a timing when the pixel drive electrode PE is fully charged, the gate control signal B is switched from the L level to the H level and the gate control signal S+ is switched from the H level to the L level. Accordingly, the pixel drive electrode PE is in the floating state, whereby a positive-polarity drive voltage is held in a liquid crystal capacitor.

On the other hand, the negative-side transistor Tr6 is turned on in a period in which the gate control signal S− indicates the H level. At this time, the gate control signal B is set to the L level, which causes the negative-side transistor Tr8 to be turned on, whereby the negative-side source follower buffer becomes active. Accordingly, the pixel drive electrode PE is charged to the voltage level of the negative-polarity video signal. Since the gate control signal B is set to the L level, the transistor Tr7 is turned on, which causes the positive-side source follower buffer to become active as well. However, since the positive-side transistor Tr5 has been turned off, the pixel drive electrode PE is not charged to the voltage level of the positive-polarity video signal. At a timing when the pixel drive electrode PE is fully charged, the gate control signal B is switched from the L level to the H level and the gate control signal S− is switched from the H level to the L level. Accordingly, since the pixel drive electrode PE is in the floating state, a negative-polarity drive voltage is held in the liquid crystal capacitor.

By alternately repeating the aforementioned operation on the positive side and operation on the negative side, the drive voltage VPE, which is made to be AC using the voltage of the positive-polarity video signal and the voltage of the negative-polarity video signal, is applied to the pixel drive electrode PE.

Since the charge held in the holding capacitors Cs1 and Cs2 is not directly transmitted to the pixel drive electrode PE and it is transmitted to the pixel drive electrode PE via the source follower buffer, even when charging and discharging of the voltages of the positive-polarity and negative-polarity video signals are repeatedly performed in the pixel drive electrode PE, it is possible to achieve pixel drive in which the voltage level does not attenuate without neutralizing the charge.

Further, as shown in FIG. 4, the voltage level of the voltage Vcom applied to the common electrode CE is switched to the level opposite to the applied voltage VPE in synchronization with the switching of the voltage level of the voltage VPE applied to the pixel drive electrode PE. The voltage Vcom applied to the common electrode CE uses a voltage which is approximately equal to an inversion reference voltage of the voltage VPE applied to the pixel drive electrode PE as an inversion reference.

Since a substantial AC voltage VLC applied to the liquid crystal LCM is a differential voltage between the voltage VPE applied to the pixel drive electrode PE and the voltage Vcom applied to the common electrode CE, an AC voltage VLC that does not include DC components is applied to the liquid crystal LCM. In this way, by switching the voltage Vcom applied to the common electrode CE in a reverse phase with respect to the voltage VPE applied to the pixel drive electrode PE, the amplitude of the voltage to be applied to the pixel drive electrode PE can be made small, whereby it is possible to reduce the breakdown voltage and power consumption of the transistors that compose a circuit part of the pixel.

Even if the current that constantly flows through the source follower buffer per pixel is a small current of 1 μA, it is possible that the current that constantly flows through all the pixels of the liquid crystal display apparatus may be too large to ignore. In a liquid crystal display apparatus having two million pixels for the full high vision, for example, it is possible that the consumed current may reach 2 A. In order to avoid this situation, in the pixels 52, the transistors Tr7 and Tr8 used as a constant current load are not always set to the ON state. Instead, the transistors Tr7 and Tr8 are set to the ON state only in a limited period within the period in which the positive-side transistor Tr5 or the negative-side transistor Tr6 is in the ON state. Accordingly, in the case in which one source follower buffer is operated, the operation of the other source follower buffer can be stopped, whereby it is possible to prevent the consumed current from being increased.

The AC drive frequency of the liquid crystal display element LC does not depend on the vertical scan frequency and can be set freely by adjusting an inversion control period of the pixel itself. For example, the vertical scan frequency is assumed to be 60 Hz, which is used for a typical TV video signal, and the number of vertical period scan lines n for the full high vision is 1125 lines. It is further assumed that the polarity changeover in each pixel is performed in a cycle of about 15 lines. In other words, it is assumed that the number of lines r for each cycle of the polarity changeover in each pixel is 30 lines. In this case, the AC drive frequency of the liquid crystal becomes 60 Hz×1125/(15×2)=2.25 kHz. That is, the liquid crystal display apparatus 50 is able to dramatically increase the AC drive frequency of the liquid crystal. Accordingly, it is possible to dramatically improve reliability, safety, and display quality of the video images displayed on a liquid crystal screen which are poor in the case in which the AC drive frequency of the liquid crystal is low.

Next, an operation of the liquid crystal display apparatus 50 in each operation mode will be described.

(Operation of Liquid Crystal Display Apparatus 50 in Image Display Mode)

Figure 6:
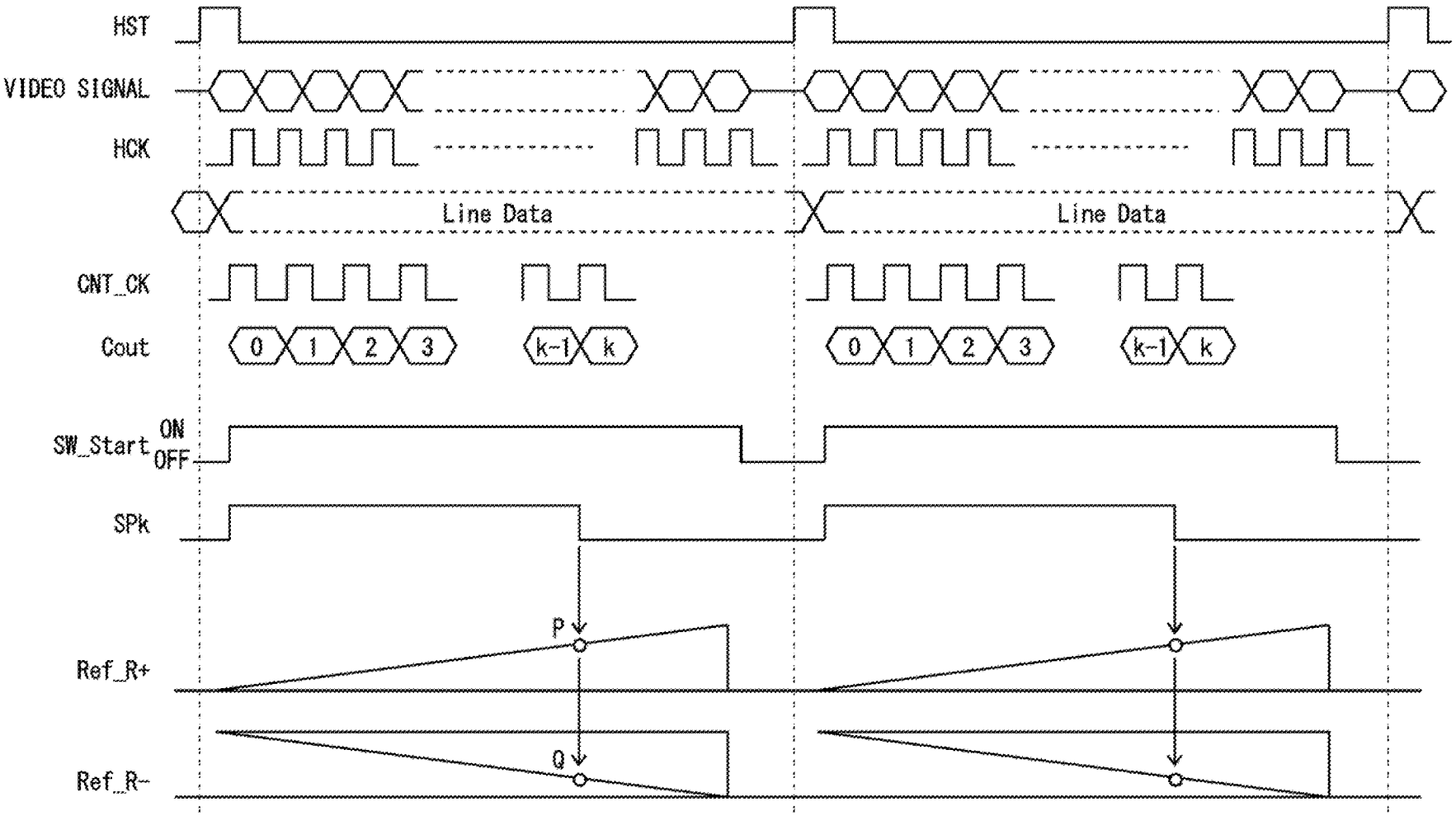
FIG. 6 is a timing chart showing an operation in an image display mode of the liquid crystal display apparatus shown in FIG. 1.

First, with reference to FIG. 6, an operation of the liquid crystal display apparatus 50 in an image display mode will be described. FIG. 6 is a timing chart showing the operation of the liquid crystal display apparatus 50 in the image display mode.

As shown in FIG. 6, when a pulse signal of a horizontal synchronization signal HST is supplied, the shift register circuit 161 sequentially takes in video signals having an N (N is an integer equal to or larger than two)-bit width for m columns in synchronization with a clock signal HCK. The one line latch circuit 162 concurrently outputs the video signals for m columns taken by the shift register circuit 161 at a timing when the trigger signal REG_S temporarily becomes active. The gradation counter 164 counts the number of times of rising of a clock signal CNT_CK and outputs a gradation signal Cout of the gradation level in accordance with the count value. The gradation counter 164 outputs the gradation signal Cout of the minimum level when one horizontal scan period is started (when the horizontal synchronization signal HST is raised), increases the gradation level of the gradation signal Cout in accordance with the increase in the count value, and outputs the gradation signal Cout at the maximum level when one horizontal scan period is ended (just before the next rising of the horizontal synchronization signal HST). Note that the count value by the gradation counter 164 is initialized to "0" when, for example, the reset signal CNT_R becomes active in accordance with the rising of the horizontal synchronization signal HST.

The comparators 163_1 to **163_*m* of m columns provided in the comparator unit 163 are operated in synchronization with a clock signal CMP_CK, and make the coincidence signals P1 to Pm active (e.g., the L level) at a timing when the gradation signal Cout output from the gradation counter 164 coincides with each of the video signals (line data) of m columns concurrently output from the one line latch circuit 162**.

The positive-side switch elements SW1+ to SWm+ of the m sets of switch elements SW1+, SW1− to SWm+, and SWm− provided in the analog switch unit 17 are respectively provided between the data lines D1+ to Dm+ and a common wiring Dcom+. Further, the negative-side switch elements SW1− to SWm− are respectively provided between the data lines D1− to Dm− and a common wiring Dcom−. The m sets of switch elements SW1+, SW1− to SWm+, and SWm− switch ON and OFF by the coincidence signals P1 to Pm from the comparators 163_1 to **163_*m***.

A reference ramp voltage Ref_R+, which is a ramp signal for the positive polarity output from the ramp signal generator 40, is supplied to the common wiring Dcom+ via an external terminal (a first external terminal). Further, a reference ramp voltage Ref_R−, which is a ramp signal for the negative polarity output from the ramp signal generator 40, is supplied to the common wiring Dcom− via an external terminal (a second external terminal).

The reference ramp voltage Ref_R+ is a sweeping signal whose video image level changes from the black level to the white level from the start to the end of each horizontal scan period. The reference ramp voltage Ref_R− is a sweeping signal whose video image level changes from the white level to the black level from the start to the end of each horizontal scan period. Therefore, the reference ramp voltage Ref_R+ with respect to the common voltage Vcom and the reference ramp voltage Ref_R− with respect to the common voltage Vcom are inverted relative to each other.

The switch elements SW1+, SW1− to SWm+, and SWm− are concurrently turned on since a start signal SW_Start becomes active (e.g., the H level) when the horizontal scan period is started. After that, the switch elements SW1+, SW1− to SWm+, and SWm− are switched from ON to OFF since the coincidence signals P1 to Pm respectively output from the comparators 163_1 to **163_*m*** become active (e.g., the L level). When the horizontal scan period is ended, the start signal SW_Start becomes inactive (e.g., the L level).

In the example shown in FIG. 6, a waveform indicating the timing of switching ON and OFF of the switch elements SWq+ and SWq−(q is any integer from 1 to m) provided so as to correspond to the pixel column into which the video signal of the gradation level k is written is indicated as a waveform SPk. With reference to FIG. 6, after the above switch elements SWq+ and SWq− are turned on since the start signal SW_Start is raised, the switch elements SWq+ and SWq− are switched from ON to OFF when the coincidence signal Pq becomes active. The switch elements SWq+ and SWq− sample the reference ramp voltages Ref_R+ and Ref_R−(voltages P and Q in FIG. 6) at the timing when they are switched from ON to OFF. These sampled voltages P and Q are supplied to the data lines Dq+ and Dq−. In other words, analog voltages P and Q, which are the results of DA conversion of the video signal of the gradation level k, are respectively supplied to the data lines Dq+ and Dq−.

In the image display mode, an H level mode switch signal MD is externally supplied. Therefore, scan pulses of n rows sequentially output from the vertical shift register and level shifter 15 one row at a time are respectively supplied to the row scan lines G1 to Gn. Accordingly, for example, the transistors Tr1 and Tr2 provided in each of the pixels 52 in the j-th row are temporarily turned on. As a result, in the holding capacitors Cs1 and Cs2 provided in each of the pixels 52 in the j-th row, the voltages of the corresponding positive-polarity and negative-polarity video signals are accumulated and held. On the other hand, since the switch selection lines for reading TG1 to TGn are in the OFF state, the transistor Tr9 provided in each of the pixels 52 maintains the off state. The following AC drive method of each of the pixels 52 has already been described above.

As described above, while the switch elements SW1+, SW1− to SWm+, and SWm− are concurrently turned on when each horizontal scan period is started, each of them is turned off at an arbitrary timing in accordance with the gradation level of the image displayed on the corresponding pixel 52. That is, all the switch elements SW1+, SW1− to SWm+, and SWm− may be concurrently turned off or they may be turned off at timings different from one another. The order in which they are turned off is not fixed.

As described above, the liquid crystal display apparatus 50 DA converts the video signal using a ramp signal and writes the obtained signal into the pixel 52, whereby it is possible to improve linearity of images.

(Operation of Liquid Crystal Display Apparatus 50 in Pixel Inspection Mode)

Next, an operation of the liquid crystal display apparatus 50 in the pixel inspection mode will be described. Note that an inspection apparatus (not shown) is provided in place of the ramp signal generator 40 in the pixel inspection mode.

In the pixel inspection mode, first, the video signal for inspection is written into m pixels 52 in the j-th row to be inspected. The operation in this case is basically similar to that in the pixel display mode. After that, the video signal (pixel drive voltage VPE) written into m pixels 52 in the j-th row to be inspected is read out.

In the pixel reading operation, the mode switch signal MD externally supplied is switched from the H level to the L level. Therefore, the scan pulse in the j-th row output from the vertical shift register and level shifter 15 is supplied to the switch selection line for reading TGj. Accordingly, the transistor Tr9 provided in each of the terminals 52 in the j-th row to be inspected is temporarily turned on. On the other hand, since the row scan line Gj have been turned off, the transistors Tr1 and Tr2 provided in each of the pixels 52 maintain the off state.

For example, in the pixel 52 provided in the j-th row and the i-th column, the transistor Tr9 is turned on, whereby the pixel drive electrode PE and the data line Di+ are made conductive. At this time, the transistors Tr7 and Tr8 are made active and one of the transistors Tr5 and Tr6 is turned on, whereby the pixel drive electrode PE is in the state in which it is driven by the source follower buffer composed of the transistors Tr3 and Tr7 or the transistors Tr4 and Tr8. Accordingly, the drive voltage VPE applied to the pixel drive electrode PE by the source follower buffer is read out to the data line Di+.

The m pixel drive voltages VPE read out from the m pixels 52 in the j-th row to be inspected to each of the data lines D1+ to Dm+ sequentially turn on the m sets of SW1+, SW1− to SWm+, and SWm− provided in the analog switch unit 17, whereby they are sequentially supplied to the common wiring Dcom+. An inspection apparatus (not shown) provided in place of the ramp signal generator 40 detects whether or not there is a failure (pixel defects and deterioration in characteristics) in the m pixels 52 in the j-th row based on the m pixel drive voltages VPE sequentially supplied via the common wiring Dcom+.

The above inspection is performed in series from the m pixels 52 in the first row to the m pixels 52 in the n-th row, one row at a time.

In the pixel 52 to be inspected, the voltage VPE of the pixel drive electrode PE driven by the source follower buffer having a low output impedance is directly read out, whereby it is possible to detect defects or deterioration in characteristics of the pixel 52 to be inspected accurately and easily.

However, in the configuration of the liquid crystal display apparatus 50, switch selection lines for reading TG1 to TGn are provided in the respective pixels 52 of n rows, which causes wiring congestion. If the wiring gap is made sufficiently large in order to avoid this wiring congestion, the pixel pitches become large, which causes a problem that the size of the circuit ends up being increased.

Specifically, in this example, the switch selection lines for reading TG1 to TGn are respectively aligned so that they are extended in the horizontal direction (the X-axis direction) between the pixels 12 of n rows that are aligned in the vertical direction (the Y-axis direction). Due to the influence of this alignment, the pixel pitch in the vertical direction (the Y-axis direction) cannot be made sufficiently small. In general, the pixel pitch in the vertical direction and the pixel pitch in the lateral direction (the X-axis direction) need to have the same value. Therefore, the pixel pitch in the lateral direction cannot be made sufficiently small unless the pixel pitch in the vertical direction is made sufficiently small. Accordingly, it is difficult to reduce the size of the pixels in the liquid crystal display apparatus 50.

If the size of the pixels cannot be made small, the size of the panel increases. Therefore, the number of chips obtained from one wafer becomes small, which causes the cost for the chip to increase. Further, in a projector on which the liquid crystal display apparatus 50 whose size of the circuit is large is mounted, the optical system becomes large, which causes the size of the projector body and the cost to increase.

In order to solve the above problem, a liquid crystal display apparatus and an inspection method thereof according to a first embodiment capable of executing inspection of pixels while reducing the pixel pitches and preventing the size of the circuit from increasing have been found.

First Embodiment

Figure 7:
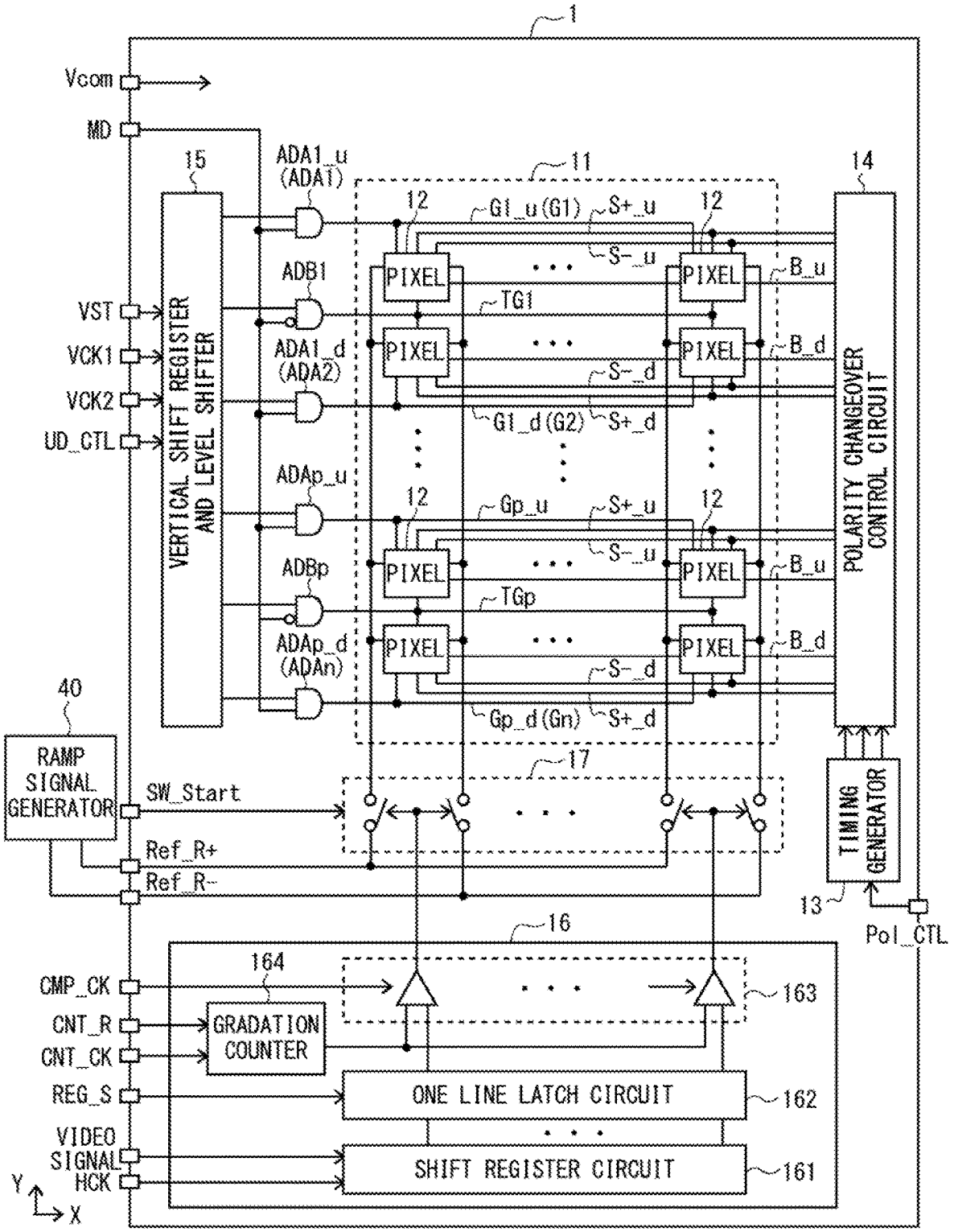
FIG. 7 is a diagram showing a configuration example of a liquid crystal display apparatus according to a first embodiment.

FIG. 7 is a diagram showing a configuration example of a liquid crystal display apparatus (liquid crystal device) 1 according to a first embodiment. The liquid crystal display apparatus 1 is different from the liquid crystal display apparatus 50 in that the number of control signal lines used at the time of pixel inspection is smaller in the liquid crystal display apparatus 1 than that in the liquid crystal display apparatus 50.

Specifically, the liquid crystal display apparatus 1 is different from the liquid crystal display apparatus 50 in that the liquid crystal display apparatus 1 includes an image display unit 11 in place of the image display unit 51 and p AND circuits ADB1 to ADBp whose number is half the number of n in place of the n AND circuits ADB1 to ADBn. FIG. 7 also shows a ramp signal generator 40 connected to the liquid crystal display apparatus 1 in the normal operation.

A horizontal driver 16, which composes a data line drive circuit together with an analog switch unit 17, includes a shift register circuit 161, a one line latch circuit 162, a comparator unit 163, and a gradation counter 164. The comparator unit 163 includes m (m is an integer equal to or larger than two) comparators 163_1 to **163_*m* that correspond to the pixels 12 of m columns. The analog switch unit 17 includes m sets of switch elements SW1+, SW1− to SWm+, and SWm− that correspond to the pixels 12** of m columns.

In the pixel region of the image display unit 11, first, row scan lines G1 to Gn of n rows (n is an even number equal to or larger than two) are arranged so that they are aligned in the vertical direction (the Y-axis direction) and are extended in the horizontal direction (the X-axis direction). In the example shown in FIG. 7, of the n row scan lines G1 to Gn, p row scan lines aligned in the odd-numbered rows are respectively indicated by row scan lines G1_*u* to Gp_u and p row scan lines aligned in the even-numbered rows are respectively indicated by row scan lines G1_*d* to Gp_d.

Further, in the example shown in FIG. 7, of n AND circuits ADA1 to ADAn, the odd-numbered p AND circuits that are provided so as to correspond to the row scan lines G1_*u* to Gp_u are respectively indicated by AND circuits ADA1_*u* to ADAp_u, and the even-numbered p AND circuits that are provided so as to correspond to the row scan lines G1_*d* to Gp_d are respectively indicated by AND circuits ADA1_*d* to ADAp_d.

Further, in the pixel region of the image display unit 11, switch selection lines for reading TG1 to TGp of p (p is half the number of n) rows are arranged so that they are aligned in the vertical direction and are extended in the horizontal direction.

Further, in the pixel region of the image display unit 11, a set of the data lines D1+, D1− to Dm+, and Dm− of m columns is arranged so that they are aligned in the horizontal direction and are extended in the vertical direction.

Further, in the pixel region of the image display unit 11, gate control signal lines S+_u, S−__u, and B_u for controlling each of the pixels 12 arranged in the odd-numbered rows (hereinafter this pixel is also referred to as a pixel 12_*u*), and gate control signal lines S+_d, S−__d, and B_d for controlling each of the pixels 12 arranged in the even-numbered rows (hereinafter this pixel is also referred to as a pixel 12_*d*) are arranged.

The image display unit 11 includes a plurality of pixels 12 that are regularly arranged. The plurality of pixels 12 are arranged in a two-dimensional matrix form at a total n×m intersection parts in which the row scan lines G1 to Gn of n rows (i.e., the row scan lines G1_*u*, G1_*d* to Gp_u, and Gp_d) extending in the horizontal direction (the X-axis direction) intersect with the m sets of data lines D1+, D1− to Dm+, and Dm− extending in the vertical direction (the Y-axis direction).

Of the n row scan lines G1 to Gn, the row scan line Gj arranged in the j (j is any integer from 1 to n)-th row is connected in common to each of the m pixels 12 arranged in the j-th row.

In other words, first, of p (p is an integer whose number is half the number of n) row scan lines G1_*u* to Gp_u aligned in the odd-numbered rows, the row scan line Gf_u aligned in the f (f is any integer from 1 to p)-th odd row is connected in common to each of them pixels 12_*u* arranged in the f-th odd row. Further, of the p row scan lines G1_*d* to Gp_d aligned in the even-numbered rows, the row scan line Gf_d arranged in the f-th even row is connected in common to each of the m pixels 12_*d* arranged in the f-th even row.

Further, a switch selection line for reading TGf (f is any integer from 1 to p) is connected in common to each of them pixels 12 arranged in the f-th odd row (i.e., the pixel 12_*u*) and the m pixels 12 arranged in the f-th even row (i.e., the pixel 12_*d*). That is, the switch selection line for reading TGf is connected in common to the m×2 pixels 12.

Further, the gate control signal lines S+_u and S−_u and the gate control signal line B_u are both connected in common to all the pixels 12 provided in the odd-numbered rows (i.e., the pixel 12_*u*), and the gate control signal lines S+_d and S−_d and the gate control signal line B_d are both connected in common to all the pixels 12 provided in the even-numbered rows (i.e., the pixel 12_*d*). Note that the gate control signal lines S+_u and S−_u and the gate control signal line B_u may both be provided separately for each of the odd-numbered rows, and the gate control signal lines S+_d and S−_d and the gate control signal line B_d may both be provided separately for each of the even-numbered rows.

<<Specific Configuration Example of Pixels 12>>

Figure 8:
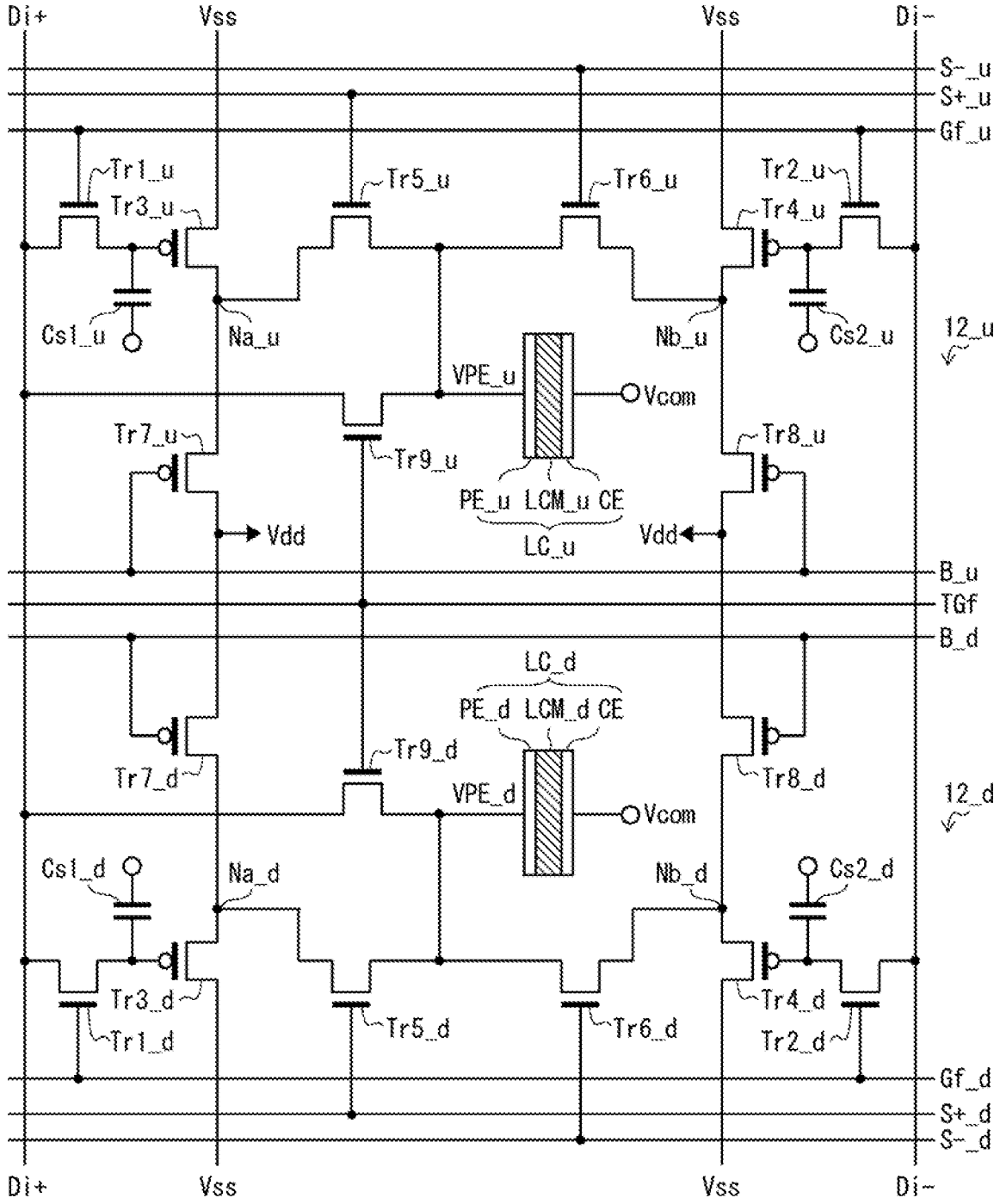
FIG. 8 is a diagram showing a specific configuration example of pixels provided in the liquid crystal display apparatus shown in FIG. 7.

FIG. 8 is a diagram showing a specific configuration example of the pixels 12 provided in the liquid crystal display apparatus 1. The example shown in FIG. 8 shows a pair of pixels formed of a pixel (first pixel) 12_*u*, which is the pixel 12 in the f-th odd row of p (p is half the number of n) odd rows and the i-th column, and a pixel (second pixel) 12_*d*, which is the pixel 12 in the f-th even row of p even rows and the i-th column.

The pixels 12_*u* and 12_*d* have a circuit configuration that is basically the same as that of the pixels 52. However, for the sake of clarification of the description, "_u" may be added to the end of the symbol given to the component of the pixel 12_*u* and "_d" may be added to the end of the symbol given to the component of the pixel 12_*d*.

With reference to FIG. 8, the pixels 12_*u* and 12_*d* are arranged adjacent to each other in the vertical direction (the Y-axis direction) and share the data lines Di+ and Di−. In the example shown in FIG. 8, the pixels 12_*u* and 12_*d* are symmetrically arranged with respect to their boundary.

In the example shown in FIG. 8, transistors Tr1_*u* to Tr9_*u*, holding capacitors Cs1_*u* and Cs2_*u*, a liquid crystal display element LC_u, a pixel drive electrode PE_u, and a liquid crystal LCM_u in the pixel 12_*u* respectively correspond to the transistors Tr1 to Tr9, the holding capacitors Cs1 and Cs2, the liquid crystal display element LC, the pixel drive electrode PE, and the liquid crystal LCM in the pixel 52. Further, transistors Tr1_*d* to Tr9_*d*, holding capacitors Cs1_*d* and Cs2_*d*, a liquid crystal display element LC_d, a pixel drive electrode PE_d, and a liquid crystal LCM_d in the pixel 12_*d* respectively correspond to the transistors Tr1 to Tr9, the holding capacitors Cs1 and Cs2, the liquid crystal display element LC, the pixel drive electrode PE, and the liquid crystal LCM in the pixel 52.

In the pixel 12_*u*, the gates of the transistors Tr1_*u* and Tr2_*u* are both connected to the row scan line Gf_u. Further, the gate of the transistor Tr5_*u* is connected to the gate control signal line S+_u and the gate of the transistor Tr6_*u* is connected to the gate control signal line S−_u. The gates of the transistors Tr7_*u* and Tr8_*u* are both connected to the gate control signal line B_u. Further, the gate of the transistor Tr9_*u* is connected to the switch selection line for reading TGf.

In the pixel 12_*d*, the gates of the transistors Tr1_*d* and Tr2_*d* are both connected to the row scan line Gf_d. Further, the gate of the transistor Tr5_*d* is connected to the gate control signal line S+_d and the gate of the transistor Tr6_*d* is connected to the gate control signal line S−_d. The gates of the transistors Tr7_*d* and Tr8_*d* are both connected to the gate control signal line B_d. Further, the gate of the transistor Tr9_*d* is connected to the switch selection line for reading TGf.

That is, the gate of the transistor Tr9_*u* provided in the pixel 12_*u* and the gate of the transistor Tr9_*d* provided in the pixel 12_*d* are connected to a common switch selection line for reading TGf. Since the other configurations of the pixels 12_*u* and 12_*d* are similar to those of the pixel 52, the descriptions thereof will be omitted.

The polarity changeover control circuit 14 outputs, based on a timing signal generated by the timing generator 13, a gate control signal for the positive polarity (gate control signals S+_u and S+_d) to the gate control signal lines S+_u and S+_d, outputs a gate control signal for the negative polarity (gate control signals S−_u and S−_d) to the gate control signal lines S−_u and S−_d, and further outputs gate control signals (gate control signals B_u and B_d) to the gate control signal lines B_u and B_d.

The vertical shift register and level shifter 15 outputs scan pulses of n rows from the first row to the n-th row, one row at a time, in series in a cycle of one horizontal scan period HST. The AND circuits ADA1 to ADAn (in other words, AND circuits ADA1_*u*, ADA1_*d* to ADAp_u, and ADAp_d) respectively control, based on the mode switch signal MD externally supplied, whether or not to output the scan pulses of n rows sequentially output from the vertical shift register and level shifter 15 one row at a time to the row scan lines G1 to Gn (in other words, row scan lines G1_*u*, G1_*d* to Gp_u, and Gp_d). Further, the AND circuits ADB1 to ADBp respectively control, based on the mode switch signal MD externally supplied, whether or not to output the scan pulses of p rows sequentially output from the vertical shift register and level shifter 15 one row at a time to the switch selection lines for reading TG1 to TGp.

In the case of an operation in which the video signal is written into the pixel 12 (image writing operation), for example, the H level mode switch signal MD is externally supplied. In this case, the AND circuits ADA1 to ADAn respectively output the scan pulses of n rows sequentially output from the vertical shift register and level shifter 15 one row at a time to the row scan lines G1 to Gn. At this time, the AND circuits ADB1 to ADBp do not respectively output the scan pulses of p rows sequentially output from the vertical shift register and level shifter 15 one row at a time to the switch selection lines for reading TG1 to TGp.

Therefore, each of the switch selection lines for reading TG1 to TGp is fixed to the L level.

On the other hand, in an operation in which the video signal written in the pixel 12 is read out (image reading operation), an L level mode switch signal MD is externally supplied. In this case, the AND circuits ADB1 to ADBp respectively output the scan pulses of p rows sequentially output from the vertical shift register and level shifter 15 one row at a time to the switch selection lines for reading TG1 to TGp. At this time, the AND circuits ADA1 to ADAn do not respectively output the scan pulses of n rows sequentially output from the vertical shift register and level shifter 15 one row at a time to the row scan lines G1 to Gn. Therefore, each of the row scan lines G1 to Gn is fixed to the L level.

<<Operation of Liquid Crystal Display Apparatus 1 in Pixel Inspection Mode>>

Next, an operation of the liquid crystal display apparatus 1 in the pixel inspection mode will be described. In the pixel inspection mode, an inspection apparatus is provided in place of the ramp signal generator 40.

Figure 9:
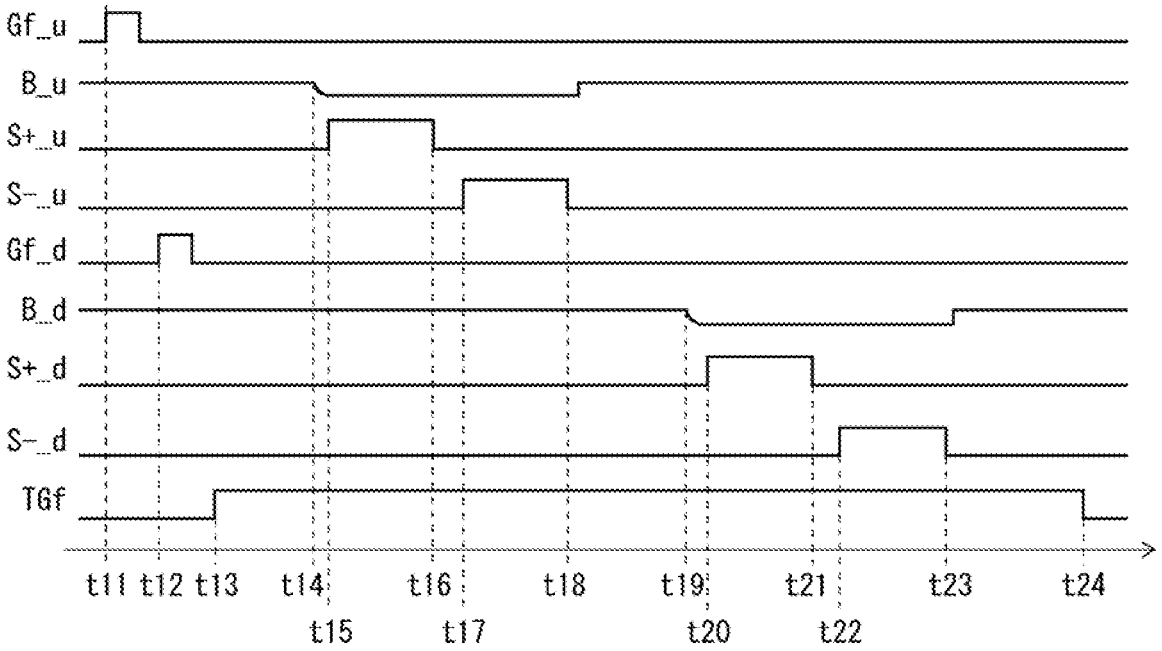
FIG. 9 is a timing chart showing an operation in a pixel inspection mode of the liquid crystal display apparatus shown in FIG. 7.

As already described above, FIG. 8 is a diagram showing the pixel 12_*u*, which is the pixel 12 in the f-th odd row of p (p is half the number of n) odd rows and the i-th column, and the pixel 12_*d*, which is the pixel 12 in the f-th even row of p even rows and the i-th column. Further, FIG. 9 is a timing chart showing an operation of the liquid crystal display apparatus 1 in the pixel inspection mode. In the following description, the inspection method of the pixels 12_*u* and 12_*d* in the i-th column that commonly use the switch selection line for reading TGf shown in FIG. 8 will be mainly described.

In the pixel inspection mode, first, the video signal for inspection is written into the pixel 12_*u* (more specifically, m pixels 12 of the row to be inspected including the pixel 12_*u*). The operation in this case is basically similar to the operation of writing the video signal in the image display mode.

Specifically, first, the switch elements SW1+, SW1− to SWm+, and SWm− provided in the analog switch unit 17 are turned on. Accordingly, the video signal for inspection output from the horizontal driver 16 is supplied to the data lines D1+, D1− to Dm+, and Dm−. Further, in this case, since the H level mode switch signal MD is externally supplied, the scan pulse output from the vertical shift register and level shifter 15 is supplied to the row scan line Gf_u. Since the row scan signal Gf_u is raised, the transistors Tr1_*u* and Tr2_*u* provided in the pixel 12_*u* (more specifically, m pixels 12 of the row to be inspected including the pixel 12_*u*) are temporarily turned on. Therefore, voltages of the video signals supplied to the data lines Di+ and Di− are accumulated and held in the holding capacitors Cs1_*u* and Cs2_*u* provided in the pixel 12_*u*, respectively (time t11). On the other hand, the transistor Tr9_*u* provided in the pixel 12_*u* (more specifically, m pixels 12 of the row to be inspected including the pixel 12_*u*) maintains the off state.

In this example, 4 V voltage is supplied to the data line Di+ and 1 V voltage is supplied to the data line Di− as video signals for inspection. Therefore, the voltage of the 4 V video signal is written into the holding capacitor Cs1_*u* and the voltage of the 1 V video signal is written into the holding capacitor Cs2_*u*.

Next, a video signal for inspection is written into the pixel 12_*d* (more specifically, m pixels 12 of the row to be inspected including the pixel 12_*d*). The operation in this case is basically similar to the operation of writing the video signal in the image display mode.

Specifically, first, the switch elements SW1+, SW1− to SWm+, and SWm− provided in the analog switch unit 17 are turned on. Accordingly, the video signal for inspection output from the horizontal driver 16 is supplied to the data lines D1+, D1− to Dm+, and Dm−. Further, at this time, the H level mode switch signal MD is externally supplied, whereby the scan pulse output from the vertical shift register and level shifter 15 is supplied to the row scan line Gf_d. Since the row scan signal Gf_d is raised, the transistors Tr1_*d* and Tr2_*d* provided in the pixel 12_*d* (more specifically, m pixels 12 of the row to be inspected including the pixel 12_*d*) are temporarily turned on. Therefore, the voltages of the video signals supplied to the data lines Di+ and Di− are accumulated and held in the holding capacitors Cs1_*d* and Cs2_*d* provided in the pixel 12_*d*, respectively (time t12). On the other hand, the transistor Tr9_*d* provided in the pixel 12_*d* (more specifically, m pixels 12 of the row to be inspected including the pixel 12_*d*) maintains the off state. In this example, as video signals for inspection, 1 V voltage is supplied to the data line Di+ and 4 V voltage is supplied to the data line Di−. Therefore, the voltage of the 1 V video signal is written into the holding capacitor Cs1_*d* and the voltage of the 4 V video signal is written into the holding capacitor Cs2_*d*.

After the video signals are written into the holding capacitors Cs1_*u*, Cs2_*u*, Cs1_*d*, and Cs2_*d*, all the switch elements SW1+, SW1− to SWm+, and SWm− provided in the analog switch unit 17 are controlled to be turned off. Accordingly, the supply of the video signals from the horizontal driver 16 to the data lines D1+, D1− to Dm+, and Dm− is stopped.

After that, the video signals written into the pixels 12_*u* and 12_*d* are read out.

First, as a preparation operation before reading, the mode switch signal MD externally supplied is switched from the H level to the L level. Accordingly, the scan pulse output from the vertical shift register and level shifter 15 is supplied to the switch selection line for reading TGf. Accordingly, the transistor Tr9_*u* provided in the pixel 12_*u* (more specifically, m pixels 12 of the row to be inspected including the pixel 12_*u*) is turned on. At the same time, the transistor Tr9_*d* provided in the pixel 12_*d* (more specifically, m pixels 12 of the row including the pixel 12_*d*) is also turned on.

When the switch selection line for reading TGf is raised, the pixel drive electrode PE_u provided in the pixel 12_*u* and the data line Di+ become conductive and the pixel drive electrode PE_d provided in the pixel 12_*d* and the data line Di+ become conductive (time t13).

In this case, the transistors Tr5_*u* and Tr6_*u* of the pixel 12_*u* and the transistors Tr5_*d* and Tr6_*d* of the pixel 12_*d* are all turned off. Therefore, of the components of the pixels 12_*u* and 12_*d*, only the pixel drive electrodes PE_u and PE_d are connected to the data line Di+.

In this example, 1 V voltage is supplied to the data line Di+ as a video signal for inspection. Therefore, voltages VPE_u and VPE_d of about 1 V are respectively written into the pixel drive electrodes PE_u and PE_d in consideration of the offset of the source follower.

The switch element SWi+ provided in the analog switch unit 17 is temporarily turned on. Accordingly, the voltage of the data line Di+ is supplied to the inspection apparatus (not shown) via the switch element SWi+ provided in the analog switch unit 17. When it has been detected that the data line Di+ indicates 1 V, for example, this inspection apparatus determines that the pixel drive electrodes PE_u and PE_d are not short-circuited with any one of the power supply voltage and the ground voltage. When it has been detected that the data line Di+ indicates the value of the power supply voltage or the ground voltage, the inspection apparatus determines that at least one of the pixel drive electrodes PE_u and PE_d is short-circuited with the power supply voltage or the ground voltage. In a similar way, the switch elements SW1+ to SWm+ provided in the analog switch unit 17 are temporarily turned on one by one in order, whereby the inspection apparatus is able to perform inspection to determine whether or not the pixel drive electrodes PE provided in m×2 pixels 12 of two rows to be inspected including the pixels 12_*u* and 12_*d* is short-circuited with the power supply voltage or the ground voltage.

Upon completion of the preparation operation before reading, for example, the positive-polarity video signal written into the positive-side holding capacitor Cs1_*u* of the pixel 12_*u* (more specifically, m pixels 12 of the row to be inspected including the pixel 12_*u*) is read out to the data line Di+.

Specifically, first, the gate control signal B_u is made active (L level), whereby the source follower buffer composed of the transistors Tr3_*u* and Tr7_*u* and the source follower buffer composed of the transistors Tr4_*u* and Tr8_*u* of the pixel 12_*u* (more specifically, m pixels 12 of the row to be inspected including the pixel 12_*u*) are operated (time t14).

After that, the gate control signal S+_u is made active (H level), whereby the positive-side transistor Tr5_*u* of the pixel 12_*u* (more specifically, m pixels 12 of the row to be inspected including the pixel 12_*u*) is turned on (time t15). Accordingly, the voltage of the positive-polarity video signal held in the holding capacitor Cs1_*u* is transmitted to the pixel drive electrode PE_u, and the voltage VPE_u of the pixel drive electrode PE_u is transmitted (read out) to the data line Di+ via the transistor Tr9_*u*.

Since the transistors Tr3_*u* and Tr7_*u* compose a source follower buffer, the data line Di+ can continue to be driven until the voltage of the data line Di+ reaches a voltage obtained by adding the threshold voltage of the transistor Tr3_u to the voltage of the positive-polarity video signal held in the holding capacitor Cs1_u.

In this example, 4 V voltage is held in the holding capacitor Cs1_u. Therefore, the source follower buffer composed of the transistors Tr3_u and Tr7_u drives the pixel drive electrode PE_u to about 5.5 V in which the threshold voltage of the transistor Tr3_u is taken into account, and further drives the data line Di+ to about 5.5 V.

Now, the switch element SWi+ provided in the analog switch unit 17 is temporarily turned on. Accordingly, the 5.5 V video signal read out from the pixel 12_u to the data line Di+ is supplied to the inspection apparatus (not shown) via the switch element SWi+ provided in the analog switch unit 17. When it has been detected that the data line Di+ indicates 5.5 V, for example, this inspection apparatus determines that there is no abnormality in the transistors Tr1_u, Tr3_u, Tr5_u, and Tr7_u and the holding capacitor Cs1_u. When it has been detected that the data line Di+ indicates a voltage other than 5.5 V, the inspection apparatus determines that there is an abnormality in any one of the transistors Tr1_u, Tr3_u, Tr5_u, and Tr7_u and the holding capacitor Cs1_u.

In a similar way, the switch elements SW1+ to SWm+ provided in the analog switch unit 17 are temporarily turned on one by one in order, whereby the inspection apparatus is able to inspect each of m pixels 12 of the row to be inspected including the pixel 12_u to determine whether or not there is an abnormality in the positive-side transistors and the positive-side holding capacitors. After that, the gate control signal S+_u is made inactive (L level), thereby turning off the positive-side transistor Tr5_u of the pixel 12_u (more specifically, m pixels 12 of the row to be inspected including the pixel 12_u) (time t16). Accordingly, inspection of the positive-side transistors and the positive-side holding capacitors provided in the pixel 12_u (more specifically, m pixels 12 of the row to be inspected including the pixel 12_u) is completed.

Next, the negative-polarity video signal written into the negative-side holding capacitor Cs2_u of the pixel 12_u (more specifically, m pixels 12 of the row to be inspected including the pixel 12_u) is read out to the data line Di+.

Specifically, by making the gate control signal S−_u active (H level), the negative-side transistor Tr6_u of the pixel 12_u (more specifically, m pixels 12 of the row to be inspected including the pixel 12_u) is turned on (time t17). Accordingly, the voltage of the negative-polarity video signal held in the holding capacitor Cs2_u is transmitted to the pixel drive electrode PE_u, and the voltage VPE_u of the pixel drive electrode PE_u is transmitted (read out) to the data line Di+ via the transistor Tr9_u.

Since the transistors Tr4_u and Tr8_u compose a source follower buffer, the data line Di+ can continue to be driven until the voltage of the data line Di+ reaches a voltage obtained by adding the threshold voltage of the transistor Tr4_u to the voltage of the negative-polarity video signal held in the holding capacitor Cs2_u.

In this example, the 1 V voltage is held in the holding capacitor Cs2_u. Therefore, the source follower buffer composed of the transistors Tr4_u and Tr8_u drives the pixel drive electrode PE_u to about 1.8 V in which the threshold voltage of the transistor Tr4_u is taken into account and further drives the data line Di+ to about 1.8 V.

The switch element SWi+ provided in the analog switch unit 17 is temporarily turned on. Accordingly, the 1.8 V video signal read out from the pixel 12_u to the data line Di+ is supplied to the inspection apparatus (not shown) via the switch element SWi+ provided in the analog switch unit 17. When it has been detected that the data line Di+ indicates 1.8 V, for example, the inspection apparatus determines that there is no abnormality in the transistors Tr2_u, Tr4_u, Tr6_u, and Tr8_u and the holding capacitor Cs2_u. On the other hand, when it has been detected that the data line Di+ indicates a voltage other than 1.8 V, the inspection apparatus determines that there is an abnormality in any one of the transistors Tr2_u, Tr4_u, Tr6_u, and Tr8_u and the holding capacitor Cs2_u. In a similar way, the switch elements SW1+ to SWm+ provided in the analog switch unit 17 are temporarily turned on one by one in order, whereby the inspection apparatus is able to inspect each of the m pixels 12 of the row to be inspected including the pixel 12_u to determine whether or not there is an abnormality in the negative-side transistors and the negative-side holding capacitors.

After that, the gate control signal S−_u is made inactive (L level), whereby the negative-side transistor Tr6_u of the pixel 12_u (more specifically, m pixels 12 of the row to be inspected including the pixel 12_u) is turned off (time t18). Accordingly, inspection of the negative-side transistors and the negative-side holding capacitors provided in the pixel 12_u (more specifically, m pixels 12 of the row to be inspected including the pixel 12_u) is completed.

Next, the positive-polarity video signal written into the positive-side holding capacitor Cs1_d of the pixel 12_d (more specifically, m pixels 12 of the row to be inspected including the pixel 12_d) is read out to the data line Di+.

Specifically, first, the gate control signal B_d is made active (L level), whereby the source follower buffer composed of the transistors Tr3_d and Tr7_d and the source follower buffer composed of the transistors Tr4_d and Tr8_d of the pixel 12_d (more specifically, m pixels 12 of the row to be inspected including the pixel 12_d) are operated (time t19).

After that, the gate control signal S+_d is made active (H level), whereby the positive-side transistor Tr5_d of the pixel 12_d (more specifically, m pixels 12 of the row to be inspected including the pixel 12_d) is turned on (time t20). Accordingly, the voltage of the positive-polarity video signal held in the holding capacitor Cs1_d is transmitted to the pixel drive electrode PE_d, and the voltage VPE_d of the pixel drive electrode PE_d is transmitted (read out) to the data line Di+ via the transistor Tr9_d.

Since the transistors Tr3_d and Tr7_d compose a source follower buffer, the data line Di+ can continue to be driven until the voltage of the data line Di+ reaches a voltage obtained by adding the threshold voltage of the transistor Tr3_d to the voltage of the positive-polarity video signal held in the holding capacitor Cs1_d.

In this example, the 1 V voltage is held in the holding capacitor Cs1_d. Therefore, the source follower buffer composed of the transistors Tr3_d and Tr7_d drives the pixel drive electrode PE_d to about 1.8 V in which the threshold voltage of the transistor Tr3_d is taken into account, and further drives the data line Di+ to about 1.8 V.

The switch element SWi+ provided in the analog switch unit 17 is temporarily turned on. Accordingly, the 1.8 V video signal read out from the pixel 12_u to the data line Di+ is supplied to the inspection apparatus (not shown) via the switch element SWi+ provided in the analog switch unit 17. When it has been detected that the data line Di+ indicates 1.8 V, for example, this inspection apparatus determines that there is no abnormality in the transistors Tr1_d, Tr3_d, Tr5_d, and Tr7_d and the holding capacitor Cs1_d. When it has been detected that the data line Di+ indicates a voltage other than 1.8 V, the inspection apparatus determines that there is an abnormality in the transistors Tr1_*d*, Tr3_*d*, Tr5_*d*, and Tr7_*d* and the holding capacitor Cs1_*d*.

In a similar way, the switch elements SW1+ to SWm+ provided in the analog switch unit 17 are temporarily turned on one by one in order, whereby the inspection apparatus is able to inspect each of m pixels 12 of the row to be inspected including the pixel 12_*d* to determine whether or not there is an abnormality in the positive-side transistors and the positive-side holding capacitors. After that, the gate control signal S+_d is made inactive (L level), thereby turning off the positive-side transistor Tr5_*d* of the pixel 12_*d* (more specifically, m pixels 12 of the row to be inspected including the pixel 12_*d*) (time t21). Accordingly, inspection of the positive-side transistors and the positive-side holding capacitors provided in the pixel 12_*d* (more specifically, m pixels 12 of the row to be inspected including the pixel 12_*d*) is completed.

Next, the negative-polarity video signal written into the negative-side holding capacitor Cs2_*d* of the pixel 12_*d* (more specifically, m pixels 12 of the row to be inspected including the pixel 12_*d*) is read out to the data line Di+.

Specifically, the gate control signal S−_d is made active (H level), whereby the negative-side transistor Tr6_*d* of the pixel 12_*d* (more specifically, m pixels 12 of the row to be inspected including the pixel 12_*d*) is turned on (time t22). Accordingly, the voltage of the negative-polarity video signal held in the holding capacitor Cs2_*d* is transmitted to the pixel drive electrode PE_d, and the voltage VPE_d of the pixel drive electrode PE_d is transmitted (read out) to the data line Di+ via the transistor Tr9_*d*.

Since the transistors Tr4_*d* and Tr8_*d* compose a source follower buffer, the data line Di+ can continue to be driven until the voltage of this data line Di+ reaches a voltage obtained by adding the threshold voltage of the transistor Tr4_*d* to the voltage of the negative-polarity video signal held in the holding capacitor Cs2_*d*.

In this example, the 4 V voltage is held in the holding capacitor Cs2_*d*. Therefore, the source follower buffer composed of the transistors Tr4_*d* and Tr8_*d* drives the pixel drive electrode PE_d to about 5.5 V in which the threshold voltage of the transistor Tr4_*d* is taken into account and further drives the data line Di+ to about 5.5 V.

In the above example, the switch element SWi+ provided in the analog switch unit 17 is temporarily turned on. Accordingly, the 5.5 V video signal read out from the pixel 12_*d* to the data line Di+ is supplied to the inspection apparatus (not shown) via the switch element SWi+ provided in the analog switch unit 17. When it has been detected that the data line Di+ indicates 5.5 V, for example, this inspection apparatus determines that there is no abnormality in the transistors Tr2_*d*, Tr4_*d*, Tr6_*d*, and Tr8_*d* and the holding capacitor Cs2_*d*. When it has been detected that the data line Di+ indicates a voltage other than 5.5 V, the inspection apparatus determines that there is an abnormality in any one of the transistors Tr2_*d*, Tr4_*d*, Tr6_*d*, and Tr8_*d* and the holding capacitor Cs2_*d*.

In a similar way, the switch elements SW1+ to SWm+ provided in the analog switch unit 17 are temporarily turned on one by one in order, whereby the inspection apparatus is able to inspect each of m pixels 12 of the row to be inspected including the pixel 12_*d* to determine whether or not there is an abnormality in the negative-side transistors and the negative-side holding capacitors.

After that, the gate control signal S−_d is made inactive (L level), thereby turning off the negative-side transistor Tr6_*d* of the pixel 12_*d* (more specifically, m pixels 12 of the row to be inspected including the pixel 12_*d*) (time t23). Accordingly, inspection of the negative-side transistor and the negative-side holding capacitor provided in the pixel 12_*d* (more specifically, m pixels 12 of the row to be inspected including the pixel 12_*d*) is completed.

After that, the mode switch signal MD externally supplied is switched from the L level to the H level. Accordingly, the switch selection line for reading TGf is fixed to the L level, whereby the transistors Tr9_*u* and Tr9_*d* provided in the pixels 12_*u* and 12_*d* (more specifically, m×2 pixels 12 of the row including the pixels 12_*u* and 12_*d*) are turned off (time t24). Accordingly, inspection of the transistors and the holding capacitors provided in the pixels 12_*u* and 12_*d* (more specifically, m×2 pixels 12 of the row including the pixels 12_*u* and 12_*d*) is completed.

The above inspection is performed in series from the m pixels 12 in the first row to the m pixels 12 in the n-th row, two rows at a time.

As described above, the liquid crystal display apparatus 1 according to this embodiment is able to inspect whether each of the transistors Tr1 to Tr9 and the holding capacitors Cs1 and Cs2 that compose each of the pixels 12 is normally operated.

Further, in the liquid crystal display apparatus 1 according to this embodiment, instead of arranging n switch selection lines for reading TG1 to TGn in the respective pixels of n rows, p switch selection lines for reading TG1 to TGp whose number is half the number of rows n are arranged in the pixels 12 of n rows. In other words, in the liquid crystal display apparatus 1 according to this embodiment, one switch selection line for reading is provided in m×2 pixels 12 of two rows. Accordingly, in the liquid crystal display apparatus 1 according to this embodiment, unlike in the liquid crystal display apparatus 50, not only the pixel pitch in the lateral direction but also that in the vertical direction can be reduced, whereby it is possible to prevent the size of the circuit from being increased. In short, the liquid crystal display apparatus 1 according to this embodiment is able to execute the inspection of pixels while preventing the size of the circuit from increasing.

When the size of the pixels is made small, the size of the panel can be reduced. Therefore, the number of chips obtained from one wafer increases, which causes the cost for the chips to decrease. Further, since the size of the optical system is reduced in a projector on which the liquid crystal display apparatus 1 whose size of the circuit is small is mounted, it is possible to reduce the size of the projector body and the cost therefor.

For example, the pixel pitch per pixel is 6 um in the liquid crystal display apparatus 50, whereas the pixel pitch per pixel can be reduced to about 5.5 um in the liquid crystal display apparatus 1. This is extremely effective to increase the number of pixels. In the case of 4K2K, for example, 2000 pixels are required in the vertical direction. Therefore, by reducing 0.5 um per pixel, the size can be reduced by about 1 mm for the entire pixels.

Note that the switch selection lines for reading TG1 to TGp are used only in a probe test performed to determine whether or not there is a failure in chips performed after the completion of the wafer but before dicing. Therefore, in each of the chips cut out from the wafer after the probe test, for example, the switch selection lines for reading TG1 to TGp are fixed to the L level voltage. In each of the chips, each of the switch selection lines for reading TG1 to TGp fixed to a predetermined voltage serves as a shield that suppresses signal crosstalk that may occur between the pixels 12 that are arranged so as to sandwich them therebetween.

For example, video signals (analog signals) independent from each other are written into the pixels 12_*u* and 12_*d* arranged so as to sandwich a switch selection line for reading TGf (f is any integer from 1 to p). If signal crosstalk occurs between the pixels 12_*u* and 12_*d*, each of the pixels 12_*u* and 12_*d* cannot be able to display the accurate picture.

Specifically, in this example, the video signal written into the pixel 12 is expressed by analog gradation. When, for example, 5.5 V is expressed by the gradation of 10 bit width, one gradation is 5.3 mV. Therefore, if deviation occurs in the signal voltage by signal crosstalk that exceeds 5.3 mV, each of the pixels 12_*u* and 12_*d* cannot be able to display the accurate picture.

In each of chips cut out from a wafer after a probe test, however, all the switch selection lines for reading TG1 to TGp are fixed to the L level voltage. Therefore, for example, the switch selection line for reading TGf aligned between the pixels 12_*u* and 12_*d* is able to suppress the signal stroke that may occur between the pixels 12_*u* and 12_*d*. That is, in each chip, the switch selection lines for reading TG1 to TGp can suppress signal crosstalk that may occur between the pixels 12 arranged so as to sandwich them.

Typically, in order to reduce the size of the pixel pitches, a gap between wiring such as signal lines needs to be made small. However, a small wiring gap causes frequent signal crosstalk between wiring. On the other hand, in this embodiment, due to the presence of the respective switch selection lines for reading TG1 to TGp, it is possible to not only reduce the pixel pitches but also suppress signal stroke that may occur between pixels arranged so as to sandwich the respective switch selection lines for reading TG1 to TGp.

Further, the liquid crystal display apparatus 1 according to this embodiment is able to inspect the variation of the threshold voltage or the amount of leakage current of each of the source follower buffer composed of the transistors Tr3 and Tr7 and the source follower buffer composed of the transistors Tr4 and Tr8. Further, the liquid crystal display apparatus 1 according to this embodiment is able to correct these variations of the threshold voltages and perform writing of the video signal in which the leakage current is taken into account.

For example, by reading out the amount of variation of the pixel drive voltage VPE in accordance with the variation of the threshold voltage and storing the amount of variation that has been read out in the external memory at the time of inspection and reflecting the offset that corresponds to the amount of the variation stored in the external memory in the normal operation after the inspection, it is possible to cancel the variation of the threshold voltage for each pixel. Accordingly, roughness of the video image on the screen caused by the variation of the threshold voltage can be suppressed, whereby uniform display characteristics can be obtained.

Further, by specifying, for example, the amount of leakage current and the position of the pixel at the time of inspection and writing the video signal in which the leakage amount is taken into account into the pixel at the target position in the normal operation after the inspection, the variation of the amount of leakage current for each pixel can be cancelled. Accordingly, it is possible to use chips that have been discarded due to a large amount of leakage current, which causes the yield to be improved.

While the case in which the positive-polarity side of the pixel 12_*u*, the negative-polarity side of the pixel 12_*u*, the positive-polarity side of the pixel 12_*d*, and the negative-polarity side of the pixel 12_*d* are inspected in this order to determine whether or not there is an abnormality therein has been described in this embodiment, this is merely an example. The order of the inspection can be changed as appropriate.

Next, some modified examples of the liquid crystal display apparatus 1 will be described.

<<First Modified Example of Liquid Crystal Display Apparatus 1>>

Figure 10:
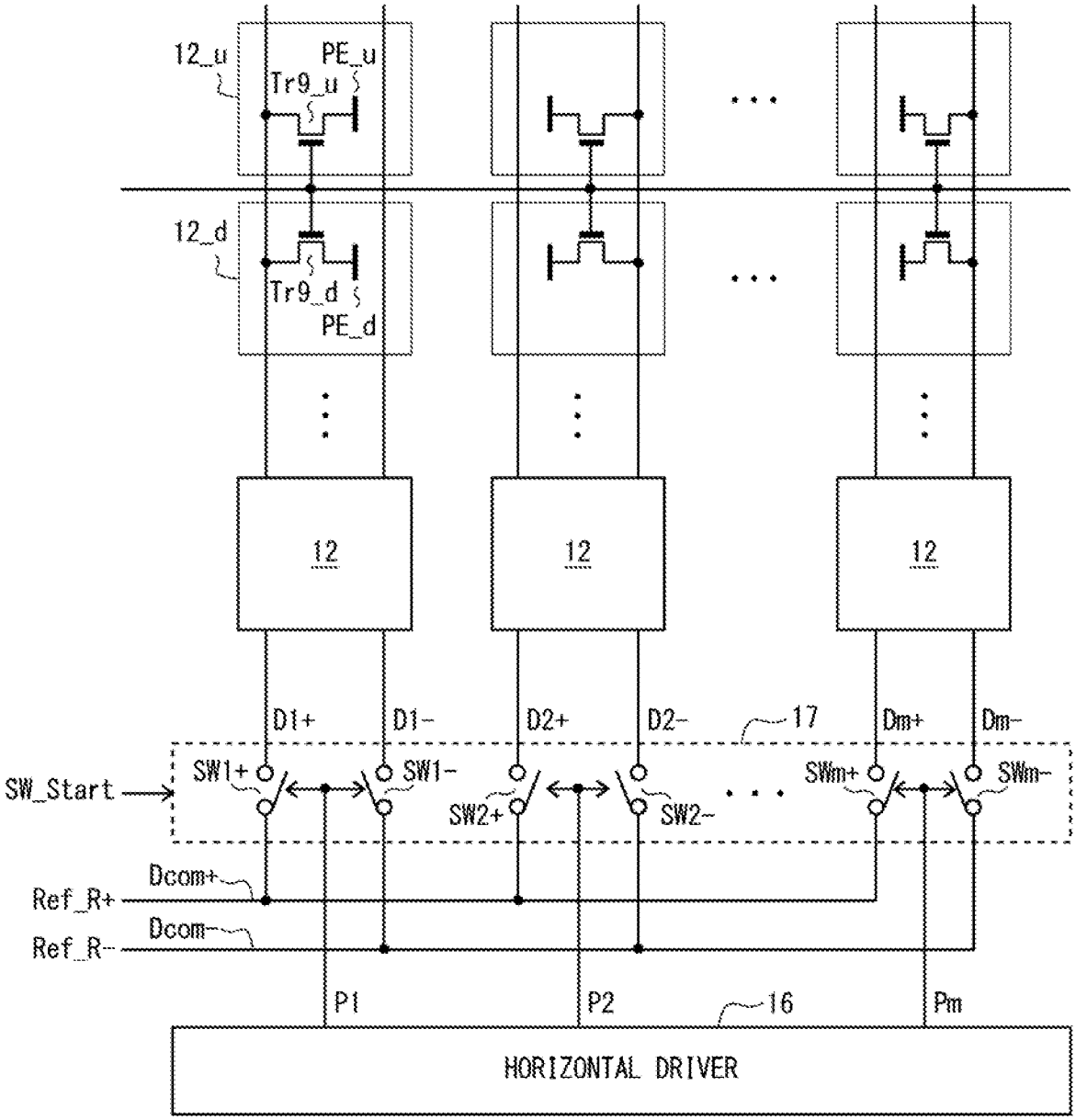
FIG. 10 is a diagram showing some of pixels, the horizontal driver, and the analog switch unit provided in a first modified example of the liquid crystal display apparatus shown in FIG. 7.

FIG. 10 is a diagram showing some of pixels 12, the horizontal driver 16, and the analog switch unit 17 provided in a first modified example of the liquid crystal display apparatus 1.

In the first modified example of the liquid crystal display apparatus 1, the transistors Tr9 of m columns provided in the respective pixels 12 of m columns are respectively connected to the data lines D1+ to Dm+. On the other hand, in the first modified example of the liquid crystal display apparatus 1, as shown in FIG. 10, the transistors Tr9 in the odd-numbered columns (Tr9_*u* and Tr9_*d*) provided in the respective pixels 12 of odd columns are connected to data lines D1+, D3+, . . . , and D(m−1)+, which are in the odd-numbered columns and on the positive side, and the transistors Tr9 in the even-numbered columns (Tr9_*u* and Tr9_*d*) provided in the respective pixels 12 of even columns are connected to data lines D2−, D4−, . . . , and Dm−, which are in the even-numbered columns and on the negative side.

Accordingly, the first modified example of the liquid crystal display apparatus 1 is able to concurrently read out a video signal for inspection written into each of two pixels 12 adjacent to each other in the horizontal direction (lateral direction) using two common wiring Dcom+ and Dcom−. For example, the first modified example of the liquid crystal display apparatus 1 is able to read out the video signal for inspection written into the pixel 12 in the second column via the data line D2−, the switch element SW2−, and the common wiring Dcom− while reading out the video signal for inspection written into the pixel 12 in the first column via the data line D1+, the switch element SW1+, and the common wiring Dcom+. Accordingly, it is possible to reduce the inspection time of all the pixels 12 by an external inspection apparatus (not shown).

<<Second Modified Example of Liquid Crystal Display Apparatus 1>>

Figure 11:
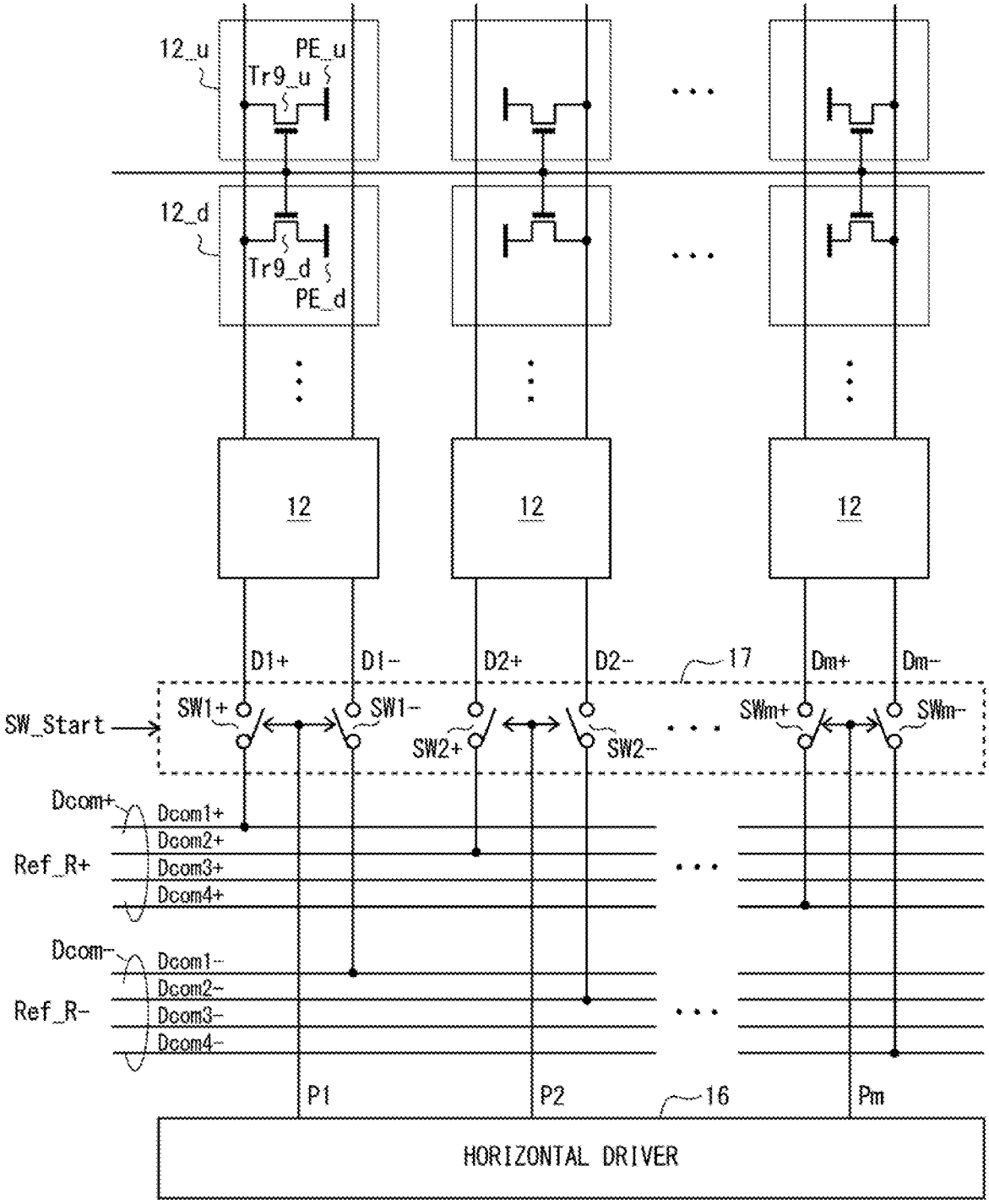
FIG. 11 is a diagram showing some of pixels, the horizontal driver, and the analog switch unit provided in a second modified example of the liquid crystal display apparatus shown in FIG. 7.

FIG. 11 is a diagram showing some of pixels 12, the horizontal driver 16, and the analog switch unit 17 provided in a second modified example of the liquid crystal display apparatus 1.

In the second modified example of the liquid crystal display apparatus 1 shown in FIG. 11, the common wiring Dcom+ is composed of four common wiring Dcom1+ to Dcom4+ and the common wiring Dcom− is composed of four common wiring Dcom1− to Dcom4−. Since the other configurations of the second modified example of the liquid crystal display apparatus 1 are similar to those of the first modified example of the liquid crystal display apparatus 1, the descriptions thereof will be omitted.

In the second modified example of the liquid crystal display apparatus 1, the positive-side data lines D1+ to Dm+ are connected to the common wiring Dcom1+ to Dcom4+ in a distributed manner via the analog switch unit 17 and the negative-side data lines D1− to Dm− are connected to the common wiring Dcom1− to Dcom4− in a distributed manner via the analog switch unit 17.

Accordingly, the second modified example of the liquid crystal display apparatus 1 is able to concurrently read out the video signals for inspection written into eight respective pixels 12 adjacent to one another in the horizontal direction (lateral direction) using eight common wiring Dcom1+ to Dcom4+ and Dcom1− to Dcom4−. Accordingly, it is possible to further reduce the inspection time of all the pixels 12 by an external inspection apparatus (not shown).

While the case in which the common wiring Dcom+ is composed of the four common wiring Dcom1+ to Dcom4+ and the common wiring Dcom− is composed of the four common wiring Dcom1− to Dcom4− has been described in the example shown in FIG. 11, this is merely an example. The common wiring Dcom+ may be composed of common wiring whose number is any number equal to or greater than two and the common wiring Dcom− may be composed of common wiring whose number is any number equal to or greater than two.

<<Third Modified Example of Liquid Crystal Display Apparatus 1>>

Figure 12:
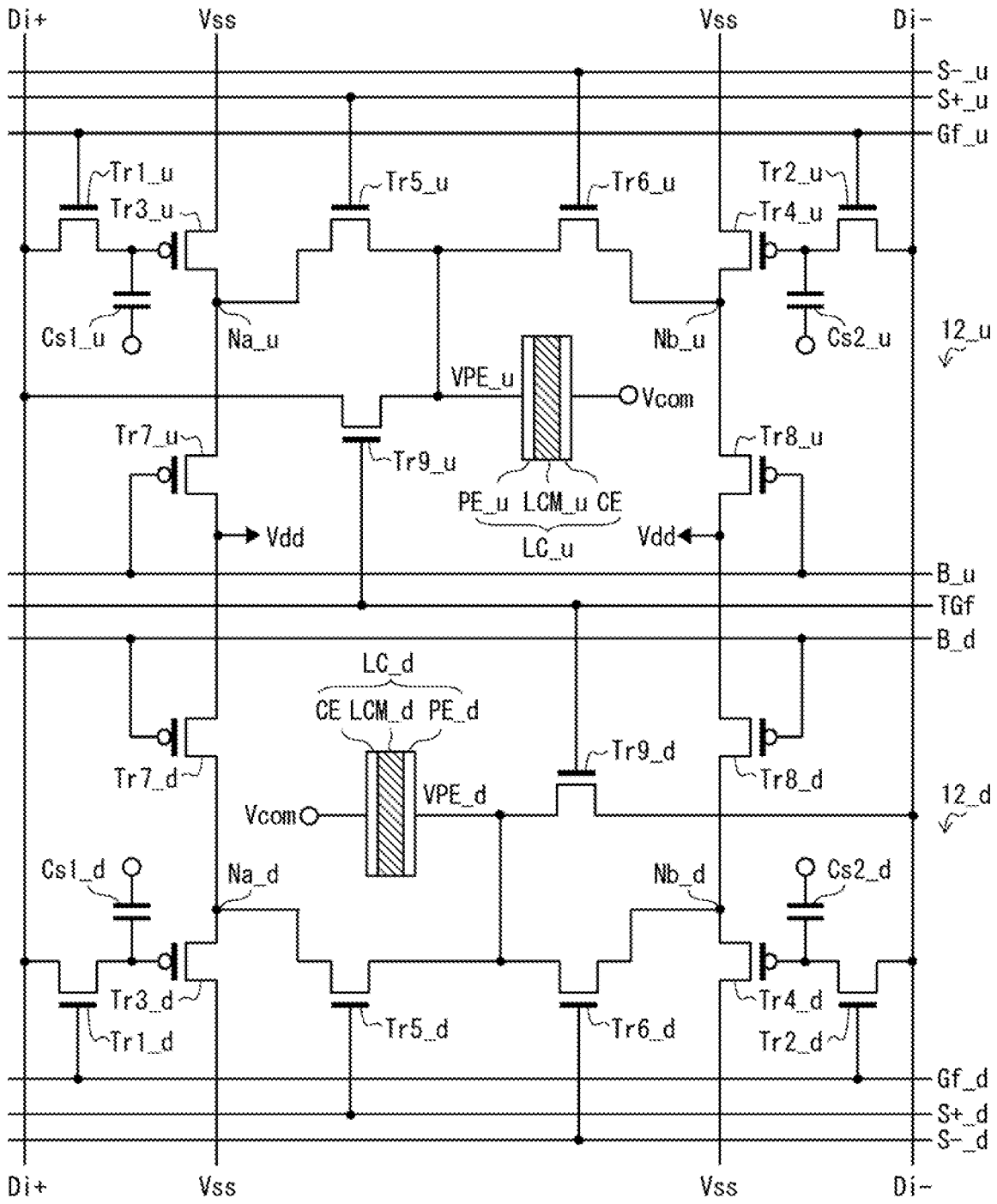
FIG. 12 is a diagram showing a specific configuration example of pixels provided in a third modified example of the liquid crystal display apparatus shown in FIG. 7.

FIG. 12 is a diagram showing some of pixels 12 provided in a third modified example of the liquid crystal display apparatus 1. In the example shown in FIG. 12, the pixel 12_*u*, which is the pixel 12 in the f (f is any integer from 1 to p)-th odd row of the p (p is half the number of n) odd rows and the i-th column, and the pixel 12_*d*, which is the pixel 12 in the f-th even row of the p even rows and the i-th column are shown.

In the example shown in FIG. 8, both the transistors Tr9_*u* and Tr9_*d* respectively provided in the pixels 12_*u* and 12_*d* are connected to the positive-side data line Di+. On the other hand, in the example shown in FIG. 12, the transistor Tr9_*u* provided in the pixel 12_*u* is connected to the positive-side data line Di+ and the transistor Tr9_*d* provided in the pixel 12_*d* is connected to the negative-side data line Di−.

Accordingly, the third modified example of the liquid crystal display apparatus 1 is able to concurrently read out the video signals for inspection written into the pair of respective pixels 12_*u* and 12_*d* that share the switch selection line for reading TGf using the two common wiring Dcom+ and Dcom−.

Specifically, for example, the third modified example of the liquid crystal display apparatus 1 is able to read out the video signal for inspection written into the pixel 12 in the second row and the first column via the data line D1−, the switch element SW−, and the common wiring Dcom− while reading out the video signal for inspection written into the pixel 12 in the first row and the first column via the data line D1+, the switch element SW1+, and the common wiring Dcom+. Accordingly, it is possible to reduce the inspection time of all the pixels 12 by an external inspection apparatus (not shown).

The common wiring Dcom+ may be composed of two or more common wiring and the common wiring Dcom− may be composed of two or more common wiring. In this case, the positive-side data lines D1+ to Dm+ are connected to a plurality of common wiring that compose the common wiring Dcom+ via the analog switch unit 17 in a distributed manner and the negative-side data lines D1− to Dm− are connected to a plurality of common wiring that compose the common wiring Dcom− via the analog switch unit 17 in a distributed manner. Accordingly, it is possible to further reduce the inspection time of all the pixels 12 by the external inspection apparatus (not shown).

<<Fourth Modified Example of Liquid Crystal Display Apparatus 1>>

Figure 13:
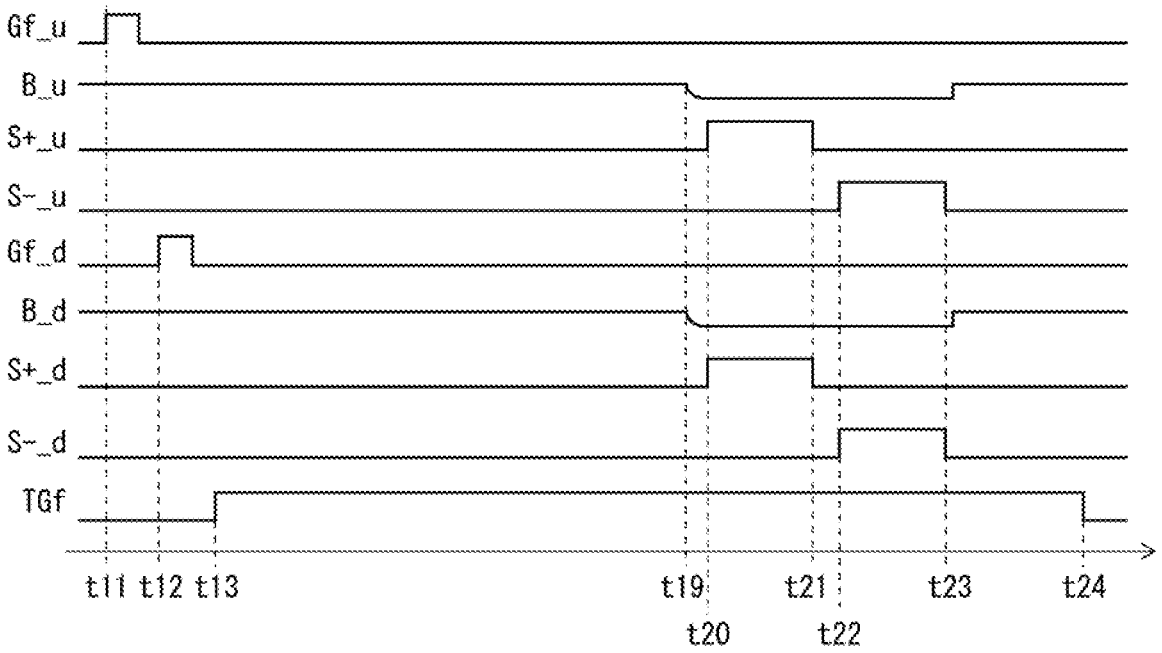
FIG. 13 is a timing chart showing an operation in a pixel inspection mode of a fourth modified example of the liquid crystal display apparatus shown in FIG. 7.

FIG. 13 is a timing chart showing an operation of a fourth modified example of the liquid crystal display apparatus 1.

As shown in FIG. 13, in the fourth modified example of the liquid crystal display apparatus 1, compared to the case in the liquid crystal display apparatus 1, the timing of reading out the positive-polarity and negative-polarity video signals written into the pixel 12_*u* is delayed, whereby the timing of reading out the positive-polarity video signal written into the pixel 12_*u* and that written into the pixel 12_*d* are made the same and the timing of reading out the negative-polarity video signal written into the pixel 12_*u* and that written into the pixel 12_*d* are made the same. In the following description, the details thereof will be described.

After the video signals for inspection are written into all the pixels 12, the preparation operation before reading is performed, and the positive-polarity video signals written into the positive-side holding capacitors Cs1_*u* and Cs1_*d* of the pixels 12_*u* and 12_*d* are read out to the data line Di+.

Specifically, the gate control signal B_u is made active (L level), whereby the source follower buffer composed of the transistors Tr3_*u* and Tr7_*u* and the source follower buffer composed of the transistors Tr4_*u* and Tr8_*u* of the pixel 12_*u* are operated (time t19). At the same time, the gate control signal B_d is made active (L level), whereby the source follower buffer composed of the transistors Tr3_*d* and Tr7_*d* and the source follower buffer composed of the transistors Tr4_*d* and Tr8_*d* of the pixel 12_*d* are operated (time t19).

After that, the gate control signal S+_u is made active (H level), whereby the positive-side transistor Tr5_*u* of the pixel 12_*u* is turned on (time t20). Accordingly, the voltage of the positive-polarity video signal held in the holding capacitor Cs1_*u* is transmitted to the pixel drive electrode PE_u, and the voltage VPE_u of the pixel drive electrode PE_u is transmitted (read out) to the data line Di+ via the transistor Tr9_*u*. At the same time, the gate control signal S+_d is made active (H level), thereby turning on the positive-side transistor Tr5_*d* of the pixel 12_*d* (time t20). Accordingly, the voltage of the positive-polarity video signal held in the holding capacitor Cs1_*d* is transmitted to the pixel drive electrode PE_d, and the voltage VPE_d of the pixel drive electrode PE_d is transmitted (read out) to the data line Di+ via the transistor Tr9_*d*.

In this example, the 4 V voltage is held in the holding capacitor Cs1_*u*. Therefore, the source follower buffer composed of the transistors Tr3_*u* and Tr7_*u* drives the pixel drive electrode PE_u to 5.5 V. Further, the 1 V voltage is held in the holding capacitor Cs1_*d*. Therefore, the source follower buffer composed of the transistors Tr3_*d* and Tr7_*d* drives the pixel drive electrode PE_d to 1.8 V. Therefore, the transistors Tr9_*u* and Tr9_*d* are concurrently turned on, whereby the data line Di+ normally indicates 3.65 V (=(5.5 V+1.8 V)/2).

The switch element SWi+ provided in the analog switch unit 17 is temporarily turned on. Accordingly, the 3.65 V video signal read out to the data line Di+ from the pixels 12_*u* and 12_*d* is supplied to the inspection apparatus (not shown) via the switch element SWi+ provided in the analog switch unit 17. When it has been detected that the data line Di+ indicates 3.65 V, for example, this inspection apparatus determines that there is no abnormality in the positive-side transistors and the positive-side holding capacitors of each of the pixels 12_*u* and 12_*d*. On the other hand, when it has been detected that the data line Di+ indicates a voltage other than 3.65 V, the above inspection apparatus determines that there is an abnormality in any one of the positive-side transistors and the positive-side holding capacitors of each of the pixels 12_*u* and 12_*d*.

In a similar way, the switch elements SW1+ to SWm+ provided in the analog switch unit 17 are temporarily turned on one by one in order, whereby the inspection apparatus is able to inspect m×2 pixels 12 of the row to be inspected including the pixels 12_*u* and 12_*d* to determine whether or not there is an abnormality in the positive-side transistors and the positive-side holding capacitors. After that, the gate control signals S+_u and S+_d are made inactive (L level), thereby turning off the positive-side transistors Tr5_*d* of the pixels 12_*u* and 12_*d* (time t21). Accordingly, inspection of the positive-side transistors and the positive-side holding capacitors provided in the pixels 12_*u* and 12_*d* is ended.

Next, the negative-polarity video signals written into the negative-side holding capacitors Cs2_*u* and Cs2_*d* of the pixels 12_*u* and 12_*d* are read out to the data line Di+.

Specifically, the gate control signal S−_u is made active (H level), thereby turning on the negative-side transistor Tr6_*u* of the pixel 12_*u* (time t22). Accordingly, the voltage of the negative-polarity video signal held in the holding capacitor Cs2_*u* is transmitted to the pixel drive electrode PE_u, and the voltage VPE_u of the pixel drive electrode PE_u is transmitted (read out) to the data line Di+ via the transistor Tr9_*u*. At the same time, the gate control signal S−_d is made active (H level), thereby turning on the negative-side transistor Tr6_*d* of the pixel 12_*d* (time t22). Accordingly, the voltage of the negative-polarity video signal held in the holding capacitor Cs2_*d* is transmitted to the pixel drive electrode PE_d, and the voltage VPE_d of the pixel drive electrode PE_d is transmitted (read out) to the data line Di+ via the transistor Tr9_*d*.

In this example, the 1 V voltage is held in the holding capacitor Cs2_*u*. Therefore, the source follower buffer composed of the transistors Tr4_*u* and Tr8_*u* drives the pixel drive electrode PE_u to about 1.8 V in which the threshold voltage of the transistor Tr4_*u* is taken into account. Further, the 4 V voltage is held in the holding capacitor Cs2_*d*. Therefore, the source follower buffer composed of the transistors Tr4_*d* and Tr8_*d* drives the pixel drive electrode PE_d to about 5.5 V in which the threshold voltage of the transistor Tr4_*d* is taken into account. Therefore, the transistors Tr9_*u* and Tr9_*d* are concurrently turned on, whereby the data line Di+ normally indicates 3.65 V (=(1.8 V+5.5 V)/2).

The switch element SWi+ provided in the analog switch unit 17 is temporarily turned on. Accordingly, the 3.65 V video signal read out to the data line Di+ from the pixels 12_*u* and 12_*d* is supplied to the inspection apparatus (not shown) via the switch element SWi+ provided in the analog switch unit 17. When it has been detected that the data line Di+ indicates 3.65 V, for example, this inspection apparatus determines that there is no abnormality in the negative-side transistors and the negative-side holding capacitors of each of the pixels 12_*u* and 12_*d*. When it has been detected that the data line Di+ indicates a voltage other than 3.65 V, the inspection apparatus determines that there is an abnormality in any one of the negative-side transistors and the negative-side holding capacitors of each of the pixels 12_*u* and 12_*d*.

In a similar way, the switch elements SW1+ to SWm+ provided in the analog switch unit 17 are temporarily turned on one by one in order, whereby the inspection apparatus is able to inspect each of m×2 pixels 12 of the row to be inspected including the pixels 12_*u* and 12_*d* to determine whether or not there is an abnormality in the negative-side transistors and the negative-side holding capacitors.

After that, the gate control signals S−_u and S−_d are made inactive (L level), thereby turning off the negative-side transistors Tr6_*d* of the pixels 12_*u* and 12_*d* (time t23). Accordingly, the inspection of the negative-side transistors and the negative-side holding capacitors provided in the pixels 12_*u* and 12_*d* is ended.

After that, the mode switch signal MD externally supplied is switched from the L level to the H level. Accordingly, since the switch selection line for reading TGf is fixed to the L level, the transistors Tr9_*u* and Tr9_*d* provided in the pixels 12_*u* and 12_*d* (more specifically, m×2 pixels 12 of the row including the pixels 12_*u* and 12_*d*) are turned off (time t24). Accordingly, inspection of the transistors and the holding capacitors provided in the pixels 12_*u* and 12_*d* (more specifically, m×2 pixels 12 of the row including the pixels 12_*u* and 12_*d*) is completed.

The above inspection is performed in series from m pixels 12 in the first row to m pixels 12 in the n-th row, two rows at a time.

As described above, the fourth modified example of the liquid crystal display apparatus 1 according to this embodiment is able to inspect each of the transistors Tr1 to Tr9 and the holding capacitors Cs1 and Cs2 that compose each of the pixels 12 to determine whether or not it is normally operated more quickly than in the liquid crystal display apparatus 1.

While the case in which the 4 V voltage is held in the holding capacitor Cs1_*u* of the pixel 12_*u* and the 1 V voltage is held in the holding capacitor Cs1_*d* of the pixel 12_*d* has been described in this embodiment, this is merely an example. Any voltage may be held in each of the holding capacitors Cs1_*u* and Cs1_*d*. In a similar way, while the case in which the 1 V voltage is held in the holding capacitor Cs2_*u* of the pixel 12_*u* and the 4 V voltage is held in the holding capacitor Cs2_*d* of the pixel 12_*d* has been described in this embodiment, this is merely an example. Any voltage may be held in each of the holding capacitors Cs2_*u* and Cs2_*d*.

Second Embodiment

In the liquid crystal display apparatus 50 shown in FIG. 1, the pixel drive voltage VPE read out from the pixel 52 to be inspected is output to the external inspection apparatus (not shown) via the data line Di+, the switch element SWi+, and the common wiring Dcom+. Therefore, the source follower buffer of the pixel 52 to be inspected needs to drive wiring having a large load capacity and a large resistance.

Specifically, the wiring capacity of the pixels 52 of n rows is added to the data line Di+. In the case of Full High Definition (FHD), for example, the wiring capacity of 1080 pixels (e.g., 1 pF) is added to the data line Di+. Further, the wiring capacity of 5 pF is, for example, added to the common wiring Dcom+. Therefore, the source follower buffer of the pixel 52 to be inspected needs to perform charging of a load capacity as high as 6 pF in total over a long period of time in order to stabilize the pixel drive voltage VPE to a level substantially equal to the voltage held in one of the holding capacitors Cs1 and Cs2. Further, in the pixel inspection mode, the pixel drive voltages VPE of all the respective pixels 52 are read out in serial, which causes the inspection time by the inspection apparatus to become extremely long. That is, in the liquid crystal display apparatus 50, there is a problem that the inspection of the pixels 52 by the inspection apparatus cannot be quickly executed. A prolonged inspection time causes an increase in the cost for the inspection.

If the pixels 52 to be inspected are inspected without waiting for the pixel drive voltage VPE to stabilize in order to reduce the inspection time, the inspection apparatus cannot accurately detect defects and the deterioration in characteristics of the pixels 52 to be inspected. In this case, for example, the pixel defects can be specified only after the entire image is displayed on the image display unit 51.

Therefore, the number of steps required for the assembly of liquid crystal and projection evaluation increases, which causes the cost to increase.

In order to solve the aforementioned problem, a liquid crystal display apparatus and an inspection method thereof according to a second embodiment capable of executing inspection of pixels quickly to reduce, for example, the cost for inspection have been found.

Figure 14:
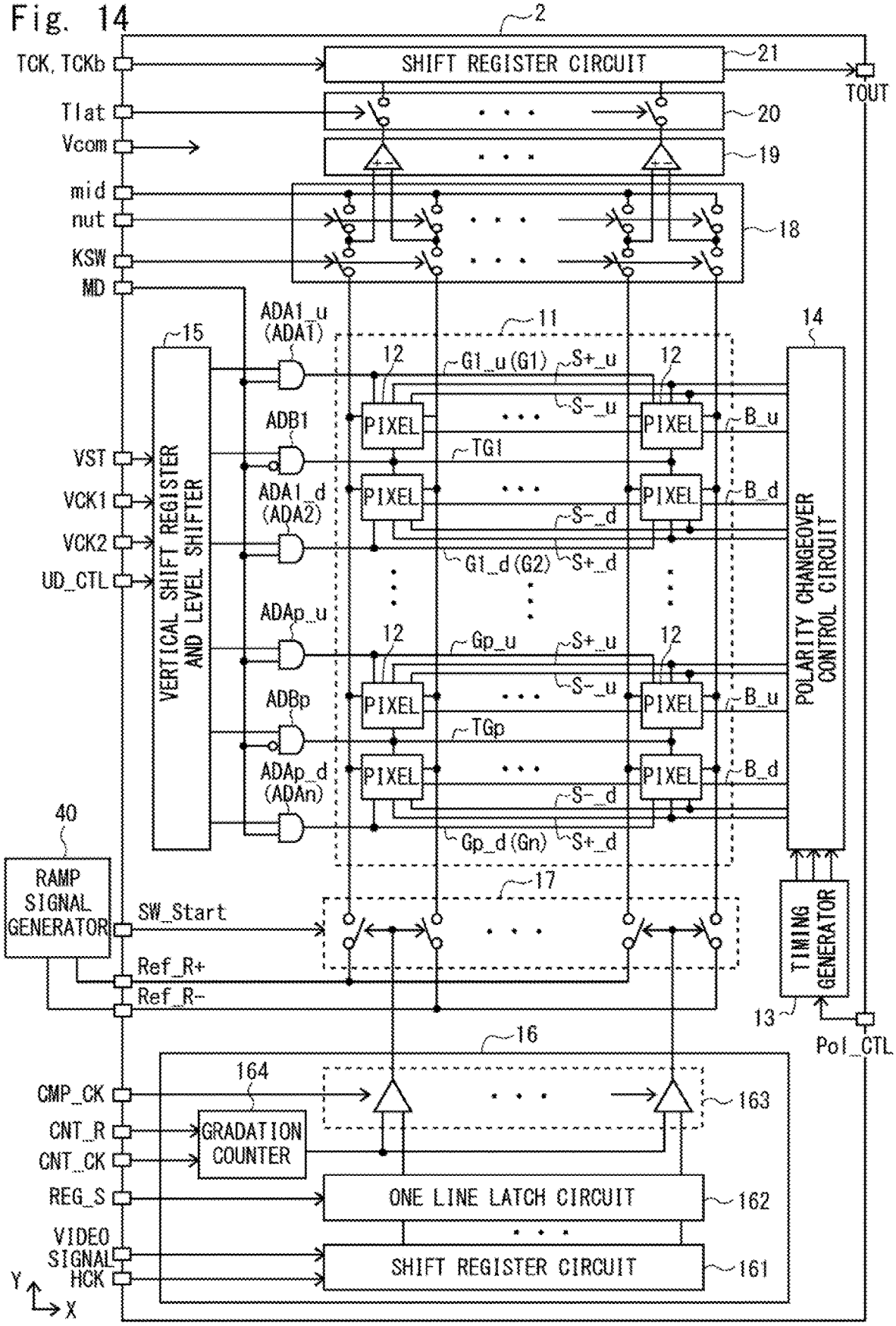
FIG. 14 is a diagram showing a configuration example of a liquid crystal display apparatus according to a second embodiment.
Figure 15:
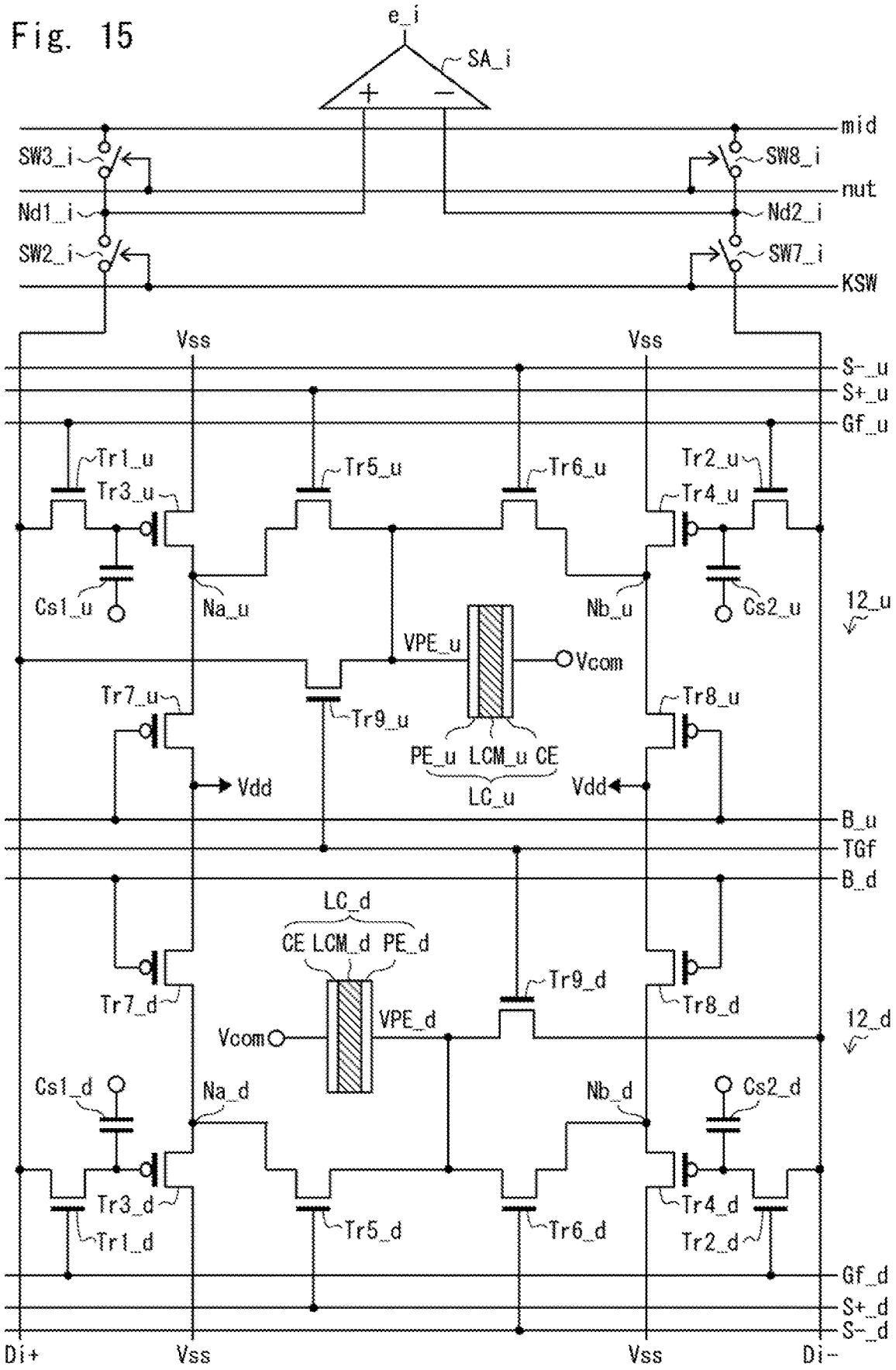
FIG. 15 is a diagram showing a specific configuration example of pixels and circuits provided near these pixels provided in the liquid crystal display apparatus shown in FIG. 14.

FIG. 14 is a diagram showing a configuration example of a liquid crystal display apparatus 2 according to the second embodiment. FIG. 14 also shows a ramp signal generator 40 connected to the liquid crystal display apparatus 2 in the normal operation. Further, FIG. 15 is a diagram showing a specific configuration example of pixels 12 and circuits provided near these pixels provided in the liquid crystal display apparatus 2. The example shown in FIG. 15 shows a pair of pixels formed of a pixel 12_*u*, which is the pixel 12 in the f-th odd row of p (p is half the number of n) odd rows and the i-th column, and a pixel 12_*d*, which is the pixel 12 in the f-th even row of p even rows and the i-th column. The liquid crystal display apparatus 2 is different from the liquid crystal display apparatus 1 in that the liquid crystal display apparatus 2 further includes, besides a path for writing the video signal into the pixel 12, a path for reading out the video signal from the pixel 12 in addition to the components of the liquid crystal display apparatus 1.

Specifically, the liquid crystal display apparatus 2 includes a switch unit 18, a sense amplifier unit 19, a latch unit 20, and a shift register circuit 21 besides the components included in the liquid crystal display apparatus 1. Further, with reference to FIG. 15, in the liquid crystal display apparatus 2, similar to the case of the third modified example of the liquid crystal display apparatus 1, which is the third modified example of the liquid crystal display apparatus 1, of the pixels 12_*u* and 12_*d* in the i-th column that commonly use the switch selection line for reading TGf, the transistor Tr9_*u* provided in the pixel 12_*u* is connected to the positive-side data line Di+ and the transistor Tr9_*d* provided in the pixel 12_*d* is connected to the negative-side data line Di−.

The switch unit 18 switches whether or not to output the m pixel drive voltages VPE read out from the m pixels 12 of the row to be inspected to the m respective data lines D1+ to Dm+ to nodes Nd1_1 to Nd1_*m*. Further, the switch unit 18 switches whether or not to output the m pixel drive voltages VPE read out from the m pixels 12 in the row to be inspected to the m respective data lines D1− to Dm− to nodes Nd2_1 to Nd2_*m*. Further, the switch unit 18 switches whether or not to output a predetermined voltage of a voltage supply line mid (predetermined voltage mid) to them sets of data lines D1+, D1− to Dm+, and Dm−.

The sense amplifier unit 19 amplifies the respective potential differences between the voltages output from the m data lines D1+ to Dm+ to the nodes Nd1_1 to Nd1_*m* via the switch unit 18 and the voltages output from the m data lines D1− to Dm− to the nodes Nd2_1 to Nd2_*m* via the switch unit 18 and outputs amplification signals e_1 to e_m. The latch unit 20 latches the amplification signals e_1 to e_m output from the sense amplifier 19 and concurrently outputs the resulting signals.

Figure 16:
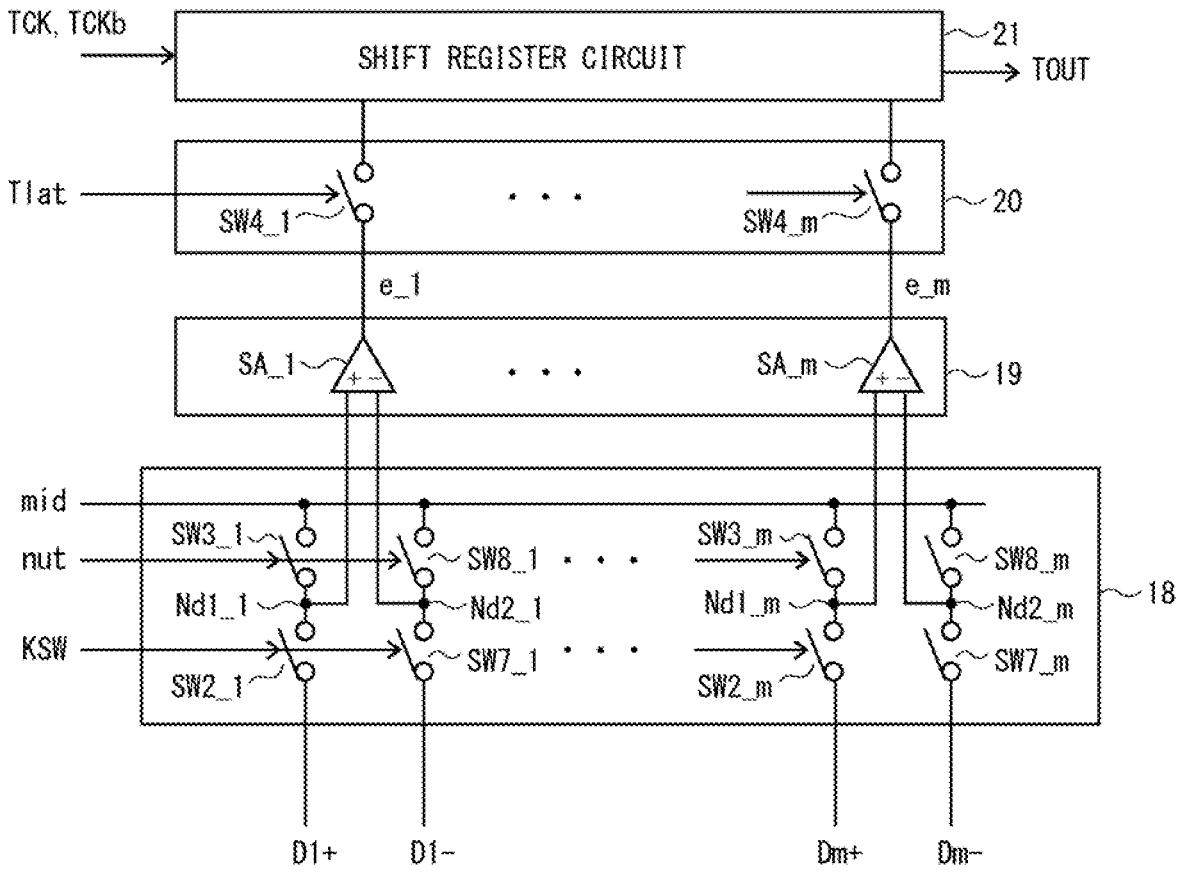
FIG. 16 is a diagram showing a switch unit, a sense amplifier unit, and a latch unit provided in the liquid crystal display apparatus shown in FIG. 14 in more detail.

FIG. 16 is a diagram showing the switch unit 18, the sense amplifier unit 19, and the latch unit 20 provided in the liquid crystal display apparatus 2 in more detail. The switch unit 18 includes m switch elements SW2_1 to SW2_*m*, m switch elements SW3_1 to SW3_*m*, m switch elements SW7_1 to SW7_*m*, and m switch elements SW8_1 to SW8_*m*. The sense amplifier unit 19 includes m sense amplifiers SA_1 to SA_m. The latch unit 20 includes m switch elements SW4_1 to SW4_*m*.

In the switch unit 18, the switch elements SW2_1 to SW2_*m* are respectively provided between the data lines D1+ to Dm+ and the nodes Nd1_1 to Nd1_*m*, and its ON and OFF are switched by a switch signal KSW. The switch elements SW3_1 to SW3_*m* are respectively provided between the nodes Nd1_1 to Nd1_*m* and the voltage supply line mid, and its ON and OFF are switched by a switch signal nut. Further, the switch elements SW7_1 to SW7_*m* are respectively provided between the data lines D1− to Dm− and the nodes Nd2_1 to Nd2_*m*, and its ON and OFF are switched by the switch signal KSW. The switch elements SW8_1 to SW8_*m* are respectively provided between the nodes Nd2_1 to Nd2_*m* and the voltage supply line mid and its ON and OFF are switched by the switch signal nut. In the sense amplifier unit 19, the sense amplifiers SA_1 to SA_m amplify the respective potential differences between the voltages of the nodes Nd1_1 to Nd1_*m* and the voltages of the nodes Nd2_1 to Nd2_*m* and output the amplification signals e_1 to e_m. In the latch unit 20, the switch elements SW4_1 to SW4_*m* are respectively provided on a signal line where the amplification signals e_1 to e_m are propagated, and its ON and OFF are switched by a trigger signal Tlat.

For example, by turning on the switch elements SW2_1 to SW2_*m* and the switch elements SW3_1 to SW3_*m*, the m data lines D1+ to Dm+ and the voltage supply line mid are short-circuited. Accordingly, the voltages of the m data lines D1+ to Dm+ are refreshed to a predetermined voltage mid. In a similar way, by turning on the switch elements SW7_1 to SW7_*m* and the switch elements SW8_1 to SW8_*m*, the m data lines D1− to Dm− and the voltage supply line mid are short-circuited. Accordingly, the voltages of them data lines D1− to Dm− are refreshed to a predetermined voltage mid.

Further, for example, by turning on the switch elements SW2_1 to SW2_*m* and turning off the switch elements SW3_1 to SW3_*m*, the m pixel drive voltages VPE read out from the m pixels 12 of the row to be inspected to the m respective data lines D1+ to Dm+ are output to the nodes Nd1_1 to Nd1_*m*. In a similar way, by turning on the switch elements SW7_1 to SW7_*m* and turning off the switch elements SW8_1 to SW8_*m*, the m pixel drive voltages VPE read out from the m pixels 12 of the row to be inspected to them respective data lines D1− to Dm− are output to the nodes Nd2_1 to Nd2_*m*. At this time, the sense amplifiers SA_1 to SA_m amplify the respective potential differences between the voltages of the nodes Nd1_1 to Nd1_*m* and the voltages of the nodes Nd2_1 to Nd2_*m* and output the amplification signals e_1 to e_m indicated by the H or L level. Then the switch elements SW4_1 to SW4_*m* provided in the latch unit 20 latch the amplification signals e_1 to e_m of the sense amplifiers SA_1 to SA_m and concurrently output the resulting signals.

<<Operation of Liquid Crystal Display Apparatus 2 in Pixel Inspection Mode>>

Figure 17:
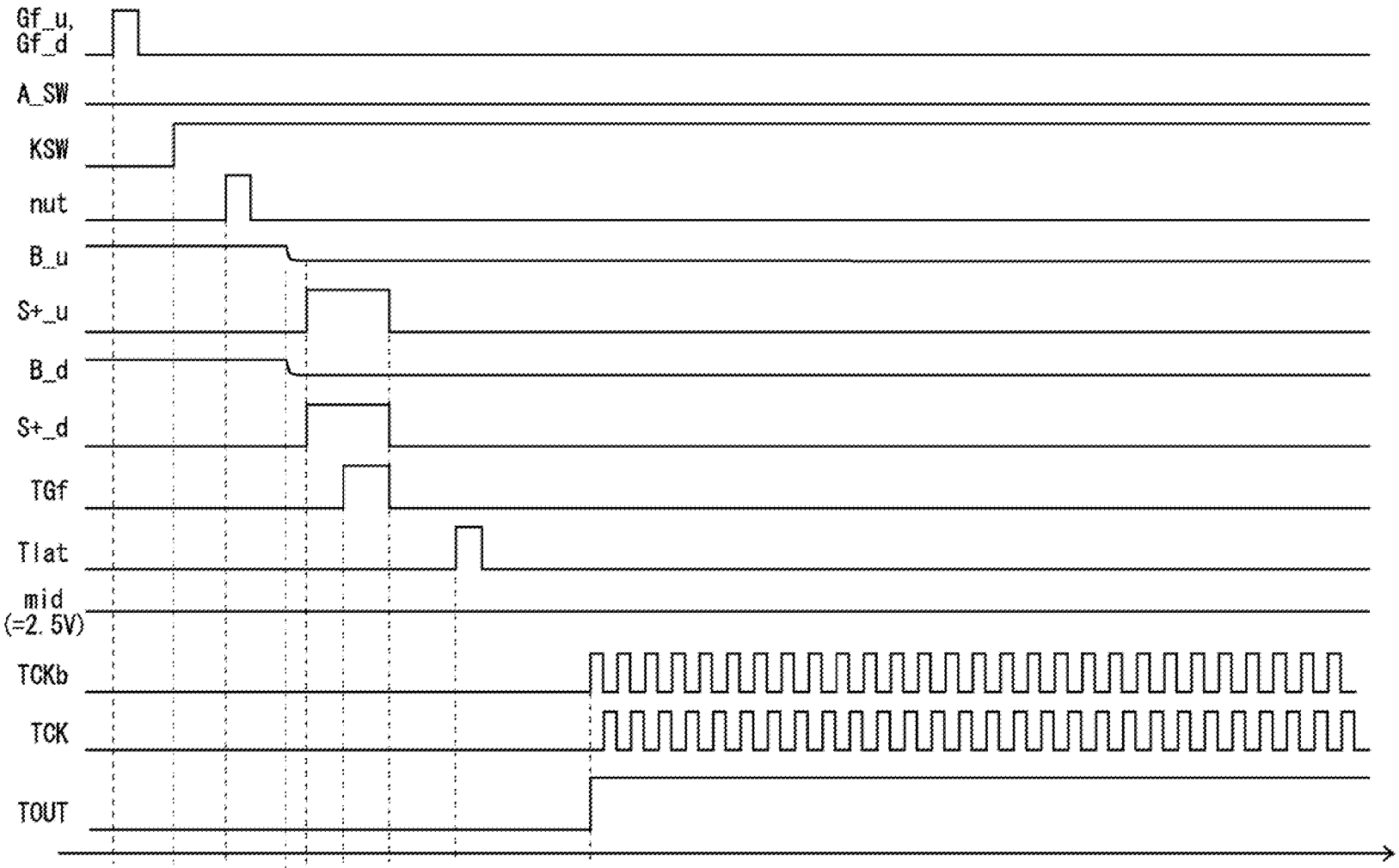
FIG. 17 is a timing chart showing an operation in a pixel inspection mode of the liquid crystal display apparatus shown in FIG. 14.

Next, an operation of the liquid crystal display apparatus 2 in the pixel inspection mode will be described. FIG. 17 is a timing chart showing an operation of the liquid crystal display apparatus 2 in the pixel inspection mode. In the following description, the inspection method of the pixels 12_*u* and 12_*d* in the i-th column that commonly use the switch selection line for reading TGf shown in FIG. 15 will be mainly described.

In the pixel inspection mode, first, the video signal for inspection is written into the pixels 12_*u* and 12_*d* (more specifically, m×2 pixels 12 of the row to be inspected including the pixels 12_*u* and 12_*d*) (time t31). Since the operation at this time is similar to that in the liquid crystal display apparatus 1, the descriptions thereof will be omitted.

In this example, one of the voltages 2.6 V and 2.4 V is written into the holding capacitor Cs1_*u* of the pixel 12_*u* and the other one of the voltages 2.6 V and 2.4 V is written into the holding capacitor Cs1_*d* of the pixel 12_*d*. Further, one of the voltages 2.6 V and 2.4 V is written into the holding capacitor Cs2_*u* of the pixel 12_*u* and the other one of the voltages 2.6 V and 2.4 V is written into the holding capacitor Cs2_*d* of the pixel 12_*d*.

After the video signal is written into the holding capacitors Cs1_*u*, Cs1_*d*, Cs2_*u*, and Cs2_*d*, all of the switch elements SW1+, SW1− to SWm+, and SWm− provided in the analog switch unit 17 are controlled to be turned off (the control signal A_SW that controls ON/OFF of each of the switch elements of the analog switch unit 17 is controlled to be inactive (L level)). Accordingly, the supply of the video signal from the horizontal driver 16 to the data lines D1+, D1− to Dm+, and Dm− is stopped.

Next, the video signal written into the pixels 12_*u* and 12_*d* is read out.

First, as a preparation operation before reading, the mode switch signal MD externally supplied is switched from the H level to the L level.

Further, by making the switch signal KSW active (e.g., the H level), the switch elements SW2_1 to SW2_*m* and SW7_1 to SW7_*m* are switched from off to on (time t32). Accordingly, the respective non-inverting input terminals of the sense amplifiers SA_1 to SA_m and the data lines D1+ to Dm+ are made conductive and the respective inverting input terminals of the sense amplifiers SA_1 to SA_m and the data lines D1− to Dm− are made conductive.

After that, the switch signal nut is temporarily made active (e.g., the H level), whereby the switch elements SW3_1 to SW3_*m* and SW8_1 to SW8_*m* are temporarily turned on (time t33). Accordingly, the data lines D1+ to Dm+ and the voltage supply line mid are short-circuited, whereby the voltages of the data lines D1+ to Dm+ are refreshed to a predetermined voltage mid. Further, the data lines D1− to Dm− and the voltage supply line mid are short-circuited and the voltages of the data lines D1− to Dm− are refreshed to a predetermined voltage mid.

Upon completion of the preparation operation before reading, for example, the positive-polarity video signal written into the positive-side holding capacitor Cs1_*u* of the pixel 12_*u* (more specifically, m pixels 12 of the row to be inspected including the pixel 12_*u*) is read out to the data line Di+ and the positive-polarity video signal written into the positive-side holding capacitor Cs1_*d* of the pixel 12_*d* (more specifically, m pixels 12 of the row to be inspected including 12_d) is read out to the data line Di−.

Specifically, first, the gate control signal B_u is made active (L level), whereby a source follower buffer composed of the transistors Tr3_*u* and Tr7_*u* and a source follower buffer composed of the transistors Tr4_*u* and Tr8_*u* of the pixel 12_*u* (more specifically, m pixels 12 of the row to be inspected including the pixel 12_*u*) are operated (time t34). At the same time, the gate control signal B_d is made active (L level), whereby a source follower buffer composed of the transistors Tr3_*d* and Tr7_*d* and a source follower buffer composed of the transistors Tr4_*d* and Tr8_*d* of the pixel 12_*d* (more specifically, m pixels 12 of the row to be inspected including the pixel 12_*d*) are operated (time t34).

After that, the gate control signal S+_u is made active (H level), thereby turning on the positive-side transistor Tr5_*u* of the pixel 12_*u* (more specifically, m pixels 12 of the row to be inspected including the pixel 12_*u*) (time t35). Accordingly, the voltage of the positive-polarity video signal held in the holding capacitor Cs1_*u* is transmitted to the pixel drive electrode PE_u. At the same time, the gate control signal S+_d is made active (H level), thereby turning on the positive-side transistor Tr5_*d* of the pixel 12_*d* (more specifically, m pixels 12 of the row to be inspected including the pixel 12_*d*) (time t35). Accordingly, the voltage of the positive-polarity video signal held in the holding capacitor Cs1_*d* is transmitted to the pixel drive electrode PE_d.

After that, the scan pulse output from the vertical shift register and level shifter 15 is supplied to the switch selection line for reading TGf (time t36). Accordingly, since the transistors Tr9_*u* and Tr9_*d* provided in the pixels 12_*u* and 12_*d* (more specifically, m×2 pixels 12 of the row to be inspected including the pixels 12_*u* and 12_*d*) are turned on, the voltages VPE_u and VPE_d of the pixel drive electrodes PE_u and PE_d are respectively read out to the data lines Di+ and Di− via the transistors Tr9_*u* and Tr9_*d* and are held.

Since all the switches of the analog switch unit 17 are controlled to be turned off, the wiring capacity of the common wiring Dcom+ of about 5 pF is not added to the data line Di+, and only the wiring capacity of pixels 12 of n rows is added. In the case of FHD, for example, only the wiring capacity of about 1 pF for 1080 pixels is added to the data line Di+. Therefore, in the liquid crystal display apparatus 2, the positive-side source follower buffer (Tr3_*u* and Tr7_*u*) provided in the pixel 12_*u* to be inspected is not affected by the wiring capacity of the common wiring Dcom+. Therefore, it is sufficient that the capacity of about one sixth in terms of a capacity be driven compared to the case of the liquid crystal display apparatus 50. Further, this positive-side source follower buffer is not affected by the wiring resistance of the common wiring Dcom+. Therefore, it is possible to reduce the time until the pixel drive voltage VPE_u is stabilized to a level substantially equal to the voltage held in the holding capacitor Cs1_*u* by the positive-side source follower buffer provided in the pixel 12_*u* to be inspected.

In a similar way, since all the switches of the analog switch unit 17 are controlled to be turned off, the wiring capacity of about 5 pF of the common wiring Dcom− is not added to the data line Di- and only the wiring capacity of pixels 12 of n rows is added. In the case of FHD, for example, only the wiring capacity of about 1 pF for 1080 pixels is added to the data line Di−. Therefore, in the liquid crystal display apparatus 2, the positive-side source follower buffers (Tr3_*d* and Tr7_*d*) provided in the pixel 12_*d* to be inspected is not affected by the wiring capacity of the common wiring Dcom−. Therefore, it is sufficient that the capacity of about one sixth in terms of a capacity be driven compared to the case of the liquid crystal display apparatus 50. Further, this positive-side source follower buffer is not affected by the wiring resistance of the common wiring Dcom−. Therefore, it is possible to reduce the time until the pixel drive voltage VPE_d is stabilized to a level substantially equal to the voltage held in the holding capacitor Cs1_*d* by the positive-side source follower buffer provided in the pixel 12_*d* to be inspected.

Further, the comparison between the magnitude of the voltage level of the data line Di+ and that of the data line Di− can be performed using a sense amplifier SA_i if the differential voltage between them becomes about several mV. Therefore, it is possible to inspect pixels without waiting for charging until the voltage level of the data line Di+ and that of the data line Di− indicate normal values.

After that, both the gate control signals S+_u and S+_d and the switch selection signal for reading TGf become inactive (L level). Accordingly, the transistors Tr5_*u* and Tr5_*d* are turned off and the transistors Tr9_*u* and Tr9_*d* are turned off (time t37).

The m positive-polarity pixel drive voltages VPE_u read out from the m pixels 12_*u* of the row to be inspected to the respective data lines D1+ to Dm+ are respectively supplied to the non-inverting input terminals of the sense amplifiers SA_1 to SA_m. The m positive-polarity pixel drive voltages VPE_d read out from them pixels 12_*d* of the row to be inspected to the respective data lines D1− to Dm− are respectively supplied to the inverting input terminals of the sense amplifiers SA_1 to SA_m.

The sense amplifiers SA_1 to SA_m amplify the potential differences between the m positive-polarity pixel drive voltages VPE_u read out to the data lines D1+ to Dm+ and the m positive-polarity pixel drive voltages VPE_d read out to the data lines D1− to Dm−, and output the amplification signals e_1 to e_m indicated by the H level or the L level.

For example, in a case in which, of the pixels 12_*u* and 12_*d* in the i-th column that commonly use the switch selection line for reading TGf, the 2.6V positive-polarity pixel drive voltage VPE_u is read out from the pixel 12_*u* to the data line Di+ and the 2.4 V positive-polarity pixel drive voltage VPE_d is read out from the pixel 12_*d* to the data line Di−, the sense amplifier SA_i outputs the H level amplification signal e_i. On the other hand, when 2.4 V positive-polarity pixel drive voltage VPE_u is read out from the pixel 12_*u* to the data line Di+ and 2.6V positive-polarity pixel drive voltage VPE_d is read out from the pixel 12_*d* to the data line Di−, the sense amplifier SA_i outputs the L level amplification signal e_i.

Then the switch elements SW4_1 to SW4_*m* provided in the latch unit 20 concurrently output amplification signals e_1 to e_m of the sense amplifiers SA_1 to SA_m at a timing when the trigger signal Tlat has temporarily become active (time t38).

After that, the shift register circuit 21 receives the amplification signals e_1 to e_m concurrently output from the latch unit 20 and outputs them as an inspection signal TOUT one by one in series (time t39).

An inspection apparatus (not shown) provided outside the liquid crystal display apparatus 2 compares the value of the inspection signal TOUT with the expected value, whereby a failure on the positive side (defects, deterioration in characteristics etc.) of m pixels 12_*u* of odd rows to be inspected is detected and a failure on the positive side of m pixels 12_*d* of even rows to be inspected is detected.

The above inspection apparatus is able to detect a failure on the negative side of the m pixels 12_*u* of odd rows to be inspected and a failure on the negative side of the m pixels 12_*d* of even rows to be inspected. Since the details of the method of detecting the failure on the negative side are basically similar to those in the case in which the failure on the positive side is detected, the descriptions thereof will be omitted. This inspection is performed in series from the m pixels 12 in the first row to the m pixels 12 in the n-th row, two rows at a time.

As described above, the liquid crystal display apparatus 2 according to this embodiment is able to achieve the effects similar to those obtained in the liquid crystal display apparatus 1. Further, the liquid crystal display apparatus 2 according to this embodiment includes, besides the path for writing the video signal into the pixel 12, the path for reading out the video signal from the pixel 12. Further, when the video signal written into the pixel 12 to be inspected is read out, a part of the path for writing the video signal into the pixel 12 is electrically separated from the data line. Accordingly, with the liquid crystal display apparatus 2 according to this embodiment, for example, it is not required to excessively charge the wiring capacities of the common wiring Dcom+ and Dcom-when the video signal written into the pixel 12 to be inspected is read out, whereby it is possible to reduce the time required to stabilize the pixel drive voltage VPE by the source follower buffer of each of the pixels 12, as a result of which the inspection of the pixels 12 by the inspection apparatus can be quickly executed. While the example in which the transistor Tr9_*u* provided in the pixel 12_*u* is connected to the positive-side data line Di+ and the transistor Tr9_*d* provided in the pixel 12_*d* is connected to the negative-side data line Di− has been described in this embodiment, this is merely an example. The transistor Tr9_*d* provided in each pixel 12_*d* may be connected to the positive data line Di+, and the transistor Tr9_*u* provided in each pixel 12_*u* may be connected to the negative data line Di−. Accordingly, the liquid crystal display apparatus 2 is able to detect a failure of each of the pixels 12 from, for example, the results of the comparison between the positive-side video signal and the negative-side video signal of each of the pixels 12.

The mechanism of the liquid crystal display apparatuses 1 and 2 according to the first and second embodiments can also be applied, for example, to a spatial light modulator (SLM) mounted on a wavelength selection optical switch apparatus (WWS; Wavelength Selective Switch) used in the field of wavelength multiplexing optical communication. The spatial light modulator is composed using, for example, a Liquid Crystal on Silicon (LCOS) technique, deflects an optical signal that is made incident on an input port, and emits the deflected optical signal from one of one or more output ports that has been selected.

More specifically, the wavelength selection optical switch apparatus includes, for example, an input port, one or more output ports, a wavelength dispersion device, an optical coupler, and a spatial light modulator. The wavelength dispersion device spatially disperses the optical signal that is made incident on the input port to a plurality of wavelength components. The optical coupler focuses the plurality of wavelength components dispersed by the wavelength dispersion device. The spatial light modulator includes, for example, a plurality of pixels 12 arranged in a matrix on an xy-plane formed of an x-axis direction deployed in accordance with the wavelength and a y-axis direction that is vertical to the x-axis direction. The plurality of pixels 12 change (i.e., deflect) the reflection direction of the optical signal focused by the optical coupler for each wavelength and emit the obtained optical signal from one of one or more output ports that has been selected.

The wavelength selection optical switch apparatus is able to achieve effects similar to those achieved in the liquid crystal display apparatuses 1 and 2 by applying the mechanism of the liquid crystal display apparatuses 1 and 2 according to the first and second embodiments to the spatial light modulator.

According to the embodiments, it is possible to provide a liquid crystal device, a wavelength selection optical switch apparatus, and a pixel inspection method of the liquid crystal device capable of executing inspection of pixels while preventing the size of the circuit from increasing.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

The first and second embodiments can be combined as desirable by one of ordinary skill in the art.

What is claimed is:

1. A liquid crystal device comprising:

a plurality of pixels arranged in a matrix;

a plurality of first data lines provided so as to correspond to respective columns of the plurality of pixels;

a plurality of second data lines provided so as to correspond to respective columns of the plurality of pixels; and a switch circuit configured to switch ON and OFF between each of the plurality of first data lines and a first external terminal and switch ON and OFF between each of the plurality of second data lines and a second external terminal, wherein the plurality of pixels form a plurality of pixel pairs, each of the pixel pairs being a first pixel and a second pixel that are two pixels adjacent to each other in one column, in each of the pixel pairs, the first pixel comprises:

a first sample and hold circuit configured to sample and hold a positive-polarity video signal supplied from the first external terminal to the corresponding first data line via the switch circuit;

a second sample and hold circuit configured to sample and hold a negative-polarity video signal supplied from the second external terminal to the corresponding second data line via the switch circuit;

a first liquid crystal display element composed of a first pixel drive electrode, a common electrode, and liquid crystal sealed therebetween;

a first polarity changeover switch configured to select one of a voltage of the positive-polarity video signal held by the first sample and hold circuit and a voltage of the negative-polarity video signal held by the second sample and hold circuit and control whether or not to apply the selected voltage to the first pixel drive electrode; and a first switch transistor configured to switch whether or not to output the voltage applied to the first pixel drive electrode via the first polarity changeover switch to the corresponding first data line or the corresponding second data line as a pixel drive voltage, the second pixel comprises:

a third sample and hold circuit configured to sample and hold a positive-polarity video signal supplied from the first external terminal to the corresponding first data line via the switch circuit;

a fourth sample and hold circuit configured to sample and hold a negative-polarity video signal supplied from the second external terminal to the corresponding second data line via the switch circuit;

a second liquid crystal display element composed of a second pixel drive electrode, a common electrode, and liquid crystal sealed therebetween;

a second polarity changeover switch configured to select one of a voltage of the positive-polarity video signal held by the third sample and hold circuit and a voltage of the negative-polarity video signal held by the fourth sample and hold circuit and control whether or not to apply the selected voltage to the second pixel drive electrode; and a second switch transistor configured to switch whether or not to output the voltage applied to the second pixel drive electrode via the second polarity changeover switch to the corresponding first data line or the corresponding second data line as a pixel drive voltage, and in each of the pixel pairs, the first switch transistor of the first pixel and the second switch transistor of the second pixel are configured so that they are controlled to be turned on or off by a common control signal that propagates through a control signal line.

2. The liquid crystal device according to claim 1, wherein in each of the pixel pairs provided in odd columns, the first switch transistor of the first pixel is provided between the first pixel drive electrode and the corresponding first data line, the second switch transistor of the second pixel is provided between the second pixel drive electrode and the corresponding first data line, in each of the pixel pairs provided in even columns, the first switch transistor of the first pixel is provided between the first pixel drive electrode and the corresponding second data line, the second switch transistor of the second pixel is provided between the second pixel drive electrode and the corresponding second data line, and the switch circuit is configured to output a pixel drive voltage read out from the pixel to be inspected provided in an odd column to the corresponding first data line to the first external terminal and output a pixel drive voltage read out from the pixel to be inspected provided in an even column to the corresponding second data line to the second external terminal.

3. The liquid crystal device according to claim 1, wherein in each of the pixel pairs, the first switch transistor of the first pixel is provided between the first pixel drive electrode and the corresponding first data line, the second switch transistor of the second pixel is provided between the second pixel drive electrode and the corresponding second data line, and the switch circuit is configured to output a pixel drive voltage read out from the first pixel to be inspected to the corresponding first data line to the first external terminal and output a pixel drive voltage read out from the second pixel to be inspected to the corresponding second data line to the second external terminal.

4. The liquid crystal device according to claim 1, wherein in each of the pixel pairs, the first switch transistor of the first pixel is provided between the first pixel drive electrode and the corresponding first data line, the second switch transistor of the second pixel is provided between the second pixel drive electrode and the corresponding second data line, and the liquid crystal device further comprises a plurality of sense amplifiers configured to amplify potential differences between a plurality of pixel drive voltages read out from the plurality of first pixels to be inspected to the plurality of respective first data lines and a plurality of pixel drive voltages read out from the plurality of second pixels to be inspected to the plurality of respective second data lines and output resulting voltage as a plurality of detection signals.

5. The liquid crystal device according to claim 1, wherein in each of the pixel pairs, the first pixel comprises:

the first switch transistor configured to switch whether or not to output the voltage applied to the first pixel drive electrode from the first sample and hold circuit via the first polarity changeover switch to the corresponding first data line as a positive-polarity pixel drive voltage; and a third switch transistor configured to switch whether or not to output the voltage applied to the first pixel drive electrode from the second sample and hold circuit via the first polarity changeover switch to the corresponding second data line as a negative-polarity pixel drive voltage, the second pixel comprises:

the second switch transistor configured to switch whether or not to output the voltage applied to the second pixel drive electrode from the third sample and hold circuit via the second polarity changeover switch to the corresponding first data line as a positive-polarity pixel drive voltage; and a fourth switch transistor configured to switch whether or not to output the voltage applied to the second pixel drive electrode from the fourth sample and hold circuit via the second polarity changeover switch to the corresponding second data line as a negative-polarity pixel drive voltage, and the liquid crystal device further comprises a plurality of sense amplifiers configured to amplify potential differences between a plurality of positive-polarity pixel drive voltages read out from the plurality of pixels of the row to be inspected to the plurality of respective first data lines and a plurality of negative-polarity pixel drive voltages read out from the plurality of pixels of the row to be inspected to the plurality of respective second data lines and output resulting voltages as a plurality of detection signals.

6. A wavelength selection optical switch apparatus comprising:

an input port;

one or more output ports; and a spatial light modulator composed of the liquid crystal device according to claim 1 including a plurality of pixels, the spatial light modulator deflecting an optical signal that is made incident on the input port and emitting the deflected optical signal from one of the one or more output ports that has been selected.

7. A pixel inspection method of a liquid crystal device comprising:

a plurality of pixels arranged in a matrix;

a plurality of first data lines provided so as to correspond to respective columns of the plurality of pixels;

a plurality of second data lines provided so as to correspond to respective columns of the plurality of pixels; and a switch circuit configured to switch ON and OFF between each of the plurality of first data lines and a first external terminal and switch ON and OFF between each of the plurality of second data lines and a second external terminal, wherein the plurality of pixels form a plurality of pixel pairs, each of the pixel pairs being a first pixel and a second pixel that are two pixels adjacent to each other in one column, in each of the pixel pairs, the first pixel comprises:

a first sample and hold circuit configured to sample and hold a positive-polarity video signal supplied from the first external terminal to the corresponding first data line via the switch circuit;

a second sample and hold circuit configured to sample and hold a negative-polarity video signal supplied from the second external terminal to the corresponding second data line via the switch circuit;

a first liquid crystal display element composed of a first pixel drive electrode, a common electrode, and liquid crystal sealed therebetween;

a first polarity changeover switch configured to select one of a voltage of the positive-polarity video signal held by the first sample and hold circuit and a voltage of the negative-polarity video signal held by the second sample and hold circuit and control whether or not to apply the selected voltage to the first pixel drive electrode; and a first switch transistor configured to switch whether or not to output the voltage applied to the first pixel drive electrode via the first polarity changeover switch to the corresponding first data line or the corresponding second data line as a pixel drive voltage, the second pixel comprises:

a third sample and hold circuit configured to sample and hold a positive-polarity video signal supplied from the first external terminal to the corresponding first data line via the switch circuit;

a fourth sample and hold circuit configured to sample and hold a negative-polarity video signal supplied from the second external terminal to the corresponding second data line via the switch circuit;

a second liquid crystal display element composed of a second pixel drive electrode, a common electrode, and liquid crystal sealed therebetween;

a second polarity changeover switch configured to select one of a voltage of the positive-polarity video signal held by the third sample and hold circuit and a voltage of the negative-polarity video signal held by the fourth sample and hold circuit and control whether or not to apply the selected voltage to the second pixel drive electrode; and a second switch transistor configured to switch whether or not to output the voltage applied to the second pixel drive electrode via the second polarity changeover switch to the corresponding first data line or the corresponding second data line as a pixel drive voltage, in each of the pixel pairs, the first switch transistor of the first pixel and the second switch transistor of the second pixel are configured so that they are controlled to be turned on or off by a common control signal that propagates through a control signal line, in the pixel pair to be inspected, both the first switch transistor of the first pixel and the second switch transistor of the second pixel are turned on, the voltage applied to the first pixel drive electrode from the first sample and hold circuit via the first polarity changeover switch is read out to the corresponding first data line or the corresponding second data line and it is detected, from the voltage that is read out, whether there is a failure, the voltage applied to the first pixel drive electrode from the second sample and hold circuit via the first polarity changeover switch is read out to the corresponding first data line or the corresponding second data line and it is detected, from the voltage that is read out, whether there is a failure, the voltage applied to the second pixel drive electrode from the third sample and hold circuit via the second polarity changeover switch is read out to the corresponding first data line or the corresponding second data line and it is detected, from the voltage that is read out, whether there is a failure, and the voltage applied to the second pixel drive electrode from the fourth sample and hold circuit via the second polarity changeover switch is read out to the corresponding first data line or the corresponding second data line and it is detected, from the voltage that is read out, whether there is a failure.

8. The pixel inspection method of the liquid crystal device according to claim 7, wherein in each of the pixel pairs provided in odd columns, the first switch transistor of the first pixel is provided between the first pixel drive electrode and the corresponding first data line, the second switch transistor of the second pixel is provided between the second pixel drive electrode and the corresponding first data line, in each of the pixel pairs provided in even columns, the first switch transistor of the first pixel is provided between the first pixel drive electrode and the corresponding second data line, the second switch transistor of the second pixel is provided between the second pixel drive electrode and the corresponding second data line, and using the switch circuit, a pixel drive voltage read out from the pixel to be inspected provided in an odd column to the corresponding first data line is output to the first external terminal and a pixel drive voltage read out from the pixel to be inspected provided in an even column to the corresponding second data line is output to the second external terminal.

9. The pixel inspection method of the liquid crystal device according to claim 7, wherein in each of the pixel pairs, the first switch transistor of the first pixel is provided between the first pixel drive electrode and the corresponding first data line, the second switch transistor of the second pixel is provided between the second pixel drive electrode and the corresponding second data line, and using the switch circuit, a pixel drive voltage read out from the first pixel to be inspected to the corresponding first data line is output to the first external terminal and a pixel drive voltage read out from the second pixel to be inspected to the corresponding second data line is output to the second external terminal.

10. The pixel inspection method of the liquid crystal device according to claim 7, wherein in each of the pixel pairs, the first switch transistor of the first pixel is provided between the first pixel drive electrode and the corresponding first data line, the second switch transistor of the second pixel is provided between the second pixel drive electrode and the corresponding second data line, the liquid crystal device further comprises a plurality of sense amplifiers, and using the plurality of sense amplifiers, potential differences between a plurality of pixel drive voltages read out from the plurality of first pixels to be inspected to the plurality of respective first data lines and a plurality of pixel drive voltages read out from the plurality of second pixels to be inspected to the plurality of respective second data lines are amplified and resulting voltages are output as a plurality of detection signals.

11. The pixel inspection method of the liquid crystal device according to claim 7, wherein in each of the pixel pairs, the first pixel comprises:

the first switch transistor configured to switch whether or not to output the voltage applied to the first pixel drive electrode from the first sample and hold circuit via the first polarity changeover switch to the corresponding first data line as a positive-polarity pixel drive voltage; and a third switch transistor configured to switch whether or not to output the voltage applied to the first pixel drive electrode from the second sample and hold circuit via the first polarity changeover switch to the corresponding second data line as a negative-polarity pixel drive voltage, the second pixel comprises:

the second switch transistor configured to switch whether or not to output the voltage applied to the second pixel drive electrode from the third sample and hold circuit via the second polarity changeover switch to the corresponding first data line as a positive-polarity pixel drive voltage; and a fourth switch transistor configured to switch whether or not to output the voltage applied to the second pixel drive electrode from the fourth sample and hold circuit via the second polarity changeover switch to the corresponding second data line as a negative-polarity pixel drive voltage, the liquid crystal device further comprises a plurality of sense amplifiers, and using the plurality of sense amplifiers, potential differences between a plurality of positive-polarity pixel drive voltages read out from the plurality of pixels of the row to be inspected to the plurality of respective first data lines and a plurality of negative-polarity pixel drive voltages read out from the plurality of pixels of the row to be inspected to the plurality of respective second data lines are amplified, and resulting voltages are output as a plurality of detection signals.

* * * * *